US011779997B2

(12) United States Patent
Itagaki et al.

(10) Patent No.: US 11,779,997 B2
(45) **Date of Patent: *Oct. 10, 2023**

(54) BINDING MACHINE

(71) Applicant: MAX CO., LTD., Tokyo (JP)

(72) Inventors: Osamu Itagaki, Tokyo (JP); Akira Kasahara, Tokyo (JP); Takahiro Nagaoka, Tokyo (JP)

(73) Assignee: MAX CO., LTD., Tokyo (JP)

( * ) Notice: Subject to any disclaimer, the term of this patent is extended or adjusted under 35 U.S.C. 154(b) by 177 days.

This patent is subject to a terminal disclaimer.

(21) Appl. No.: 17/133,258

(22) Filed: Dec. 23, 2020

(65) Prior Publication Data

US 2021/0138527 A1 May 13, 2021

Related U.S. Application Data

(62) Division of application No. 15/577,301, filed as application No. PCT/JP2016/071416 on Jul. 21, 2016, now Pat. No. 10,906,086.

(30) Foreign Application Priority Data

Jul. 22, 2015 (JP) ..... 2015-145283
Jul. 8, 2016 (JP) ..... 2016-136067

(51) Int. Cl.
*E04G 21/12* (2006.01)
*B21F 15/04* (2006.01)
(Continued)

(52) U.S. Cl.
CPC ..... *B21F 15/06* (2013.01); *B21F 7/00* (2013.01); *B21F 15/04* (2013.01); *B25B 25/00* (2013.01);
(Continued)

(58) Field of Classification Search
CPC .. B21F 15/04; B21F 7/00; B21F 23/00; B65B 13/28; B65B 13/025; B65B 13/285;
(Continued)

(56) References Cited

U.S. PATENT DOCUMENTS 4,865,087 A * 9/1989 Geiger ..... B65B 13/285 140/57
5,505,504 A 4/1996 Sato et al.
(Continued)

FOREIGN PATENT DOCUMENTS

CL 2009001205 A1 6/2010
CL 2009001207 A1 9/2010
(Continued)

OTHER PUBLICATIONS

First Examination Report dated Jun. 19, 2018 from corresponding NZ Patent Application No. 738553 (3 pages).
(Continued)

*Primary Examiner* — Bobby Yeonjin Kim
(74) *Attorney, Agent, or Firm* — Weihrouch IP

(57) ABSTRACT

A reinforcing bar binding machine includes a magazine in which two wires are housed in a drawable manner; a curl guide unit that winds the juxtaposed wires around the reinforcing bars and a wire feeding unit that winds the wires around the reinforcing bars with the curl guide unit in an operation of juxtaposing and feeding the wires so that the wires are wound around the reinforcing bars. In addition, the binding machine includes a binding unit that twists crossing portions of one end side and the other end side of each of the wires wound around the reinforcing bars. The binding unit further includes a bending portion that bends the one end side and the other end side of each of the wires, which are wound around the reinforcing bars, toward the reinforcing bars.

4 Claims, 28 Drawing Sheets

(51) Int. Cl.

| | |
|---|---|
| ***B65B 13/28*** | (2006.01) |
| ***B65B 27/10*** | (2006.01) |
| ***B21F 7/00*** | (2006.01) |
| ***B25B 25/00*** | (2006.01) |
| ***B21F 15/06*** | (2006.01) |

(52) U.S. Cl.
CPC ..... *B65B 13/285* (2013.01); *B65B 27/10* (2013.01); *E04G 21/12* (2013.01); *E04G 21/123* (2013.01)

(58) Field of Classification Search
CPC ..... B65B 13/04; B65B 13/06; B65B 27/10; B65B 13/185; B65B 13/184; E04G 21/123; B25B 25/00
See application file for complete search history.

(56) References Cited

U.S. PATENT DOCUMENTS

| | | | | |
|---|---|---|---|---|
| 5,682,927 | A * | 11/1997 | Takahashi | B65B 27/10 140/119 |
| 5,913,341 | A | 6/1999 | Jones | |
| 5,944,064 | A | 8/1999 | Saito et al. | |
| 2004/0244866 | A1 | 12/2004 | Ishikawa et al. | |
| 2005/0005991 | A1 | 1/2005 | Ishikawa et al. | |
| 2005/0005992 | A1 | 1/2005 | Kusakari et al. | |
| 2009/0283167 | A1 | 11/2009 | Nakagawa et al. | |
| 2009/0283170 | A1 | 11/2009 | Nagaoka | |
| 2009/0283171 | A1 | 11/2009 | Nagaoka et al. | |
| 2010/0147411 | A1 | 6/2010 | Kusakari et al. | |
| 2012/0111206 | A1 | 5/2012 | Barnes et al. | |
| 2012/0118176 | A1 * | 5/2012 | Gregersen | E04G 21/122 100/2 |
| 2014/0091171 | A1 | 4/2014 | Nakagawa et al. | |
| 2014/0246114 | A1 | 9/2014 | Kusakari et al. | |
| 2015/0266082 | A1 | 9/2015 | Horn | |
| 2015/0267423 | A1 | 9/2015 | Kusakari et al. | |
| 2016/0222683 | A1 | 8/2016 | Kusakari et al. | |
| 2018/0148943 | A1 | 5/2018 | Itagaki et al. | |
| 2018/0155940 | A1 | 6/2018 | Nagaoka et al. | |
| 2018/0363309 | A1 | 12/2018 | Kusakari | |

FOREIGN PATENT DOCUMENTS

| | | | |
|---|---|---|---|
| CL | 2015000677 | A1 | 7/2015 |
| CL | 2017003253 | A1 | 6/2018 |
| CL | 2017003254 | A1 | 6/2018 |
| CN | 1075687 | A | 9/1993 |
| CN | 201329968 | Y | 10/2009 |
| EP | 0751269 | A1 | 1/1997 |
| GB | 2 217 961 | A | 11/1989 |
| JP | S60-217920 | A | 10/1985 |
| JP | 6-167115 | A | 6/1994 |
| JP | 2005170489 | A | 6/2005 |
| JP | 2010-112107 | A | 5/2010 |
| JP | 4570972 | B2 | 10/2010 |
| JP | 4747455 | B2 | 8/2011 |
| JP | 5674762 | B2 | 2/2015 |
| RU | 2 490 407 | C2 | 8/2013 |
| RU | 2 518 167 | C2 | 6/2014 |
| TW | 529984 | B | 5/2003 |
| TW | 200300120 | A | 5/2003 |
| WO | 96/25330 | A1 | 8/1996 |
| WO | 2005/037490 | A1 | 4/2005 |

OTHER PUBLICATIONS

International Search Report dated Sep. 20, 2016 in PCT/JP2016/071416 (3 pages) and Written Opinion of the International Search Authority (3 pages).
Office Action dated Oct. 25, 2018 in corresponding Russian Patent Application No. 2017144209 (English translation) (11 pages).
Chinese Office Action issued in Application No. 201680036159.6, dated May 7, 2019, with English Translation, 12 pages.
Supplementary European Search Report issued in Application No. 16827828.1, dated Jan. 24, 2019 (7 pages).
Office Action for JP Patent Appl. No. 2020-083232 dated Mar. 30, 2021 (2 pages).
Chinese Office Action for CN Application No. 202011271519.5 dated Dec. 2, 2021. (6 pp.).
Russian Search Report for Russian Application No. 2019114424 dated Sep. 12, 2022, with English translation. (4 pp.).

* cited by examiner

BINDING MACHINE

CROSS-REFERENCE TO RELATED APPLICATION

This application is a divisional of U.S. patent application Ser. No. 15/577,301, filed on Nov. 27, 2017, which is a 35 U.S.C. § 371 National Phase Entry Application from PCT/JP2016/071416, filed Jul. 21, 2016, which claims priority from Japanese Patent Application No. 2016-136067, filed on Jul. 8, 2016, and Japanese Patent Application No. 2015-145283, filed on Jul. 22, 2015, the entire contents of which are incorporated herein by reference.

TECHNICAL FIELD

The present invention relates to a binding machine for binding a binding object such as reinforcing bars with a wire.

BACKGROUND ART

In the related art, there has been suggested a binding machine called a reinforcing bar binding machine which winds a wire around two or more reinforcing bars and twists the wound wire to bind the two or more reinforcing bars.

Such a conventional reinforcing bar binding machine has a configuration in which a wire is fed and wound around reinforcing bars and then is cut, and a portion at which one end side and the other end side of the wire intersect each other is twisted to bind the reinforcing bars (for example, see Patent Literature 1).

In the conventional reinforcing bar binding machine, the wire binding the reinforcing bars has such a form that one end and the other end of the wire are directed to the side opposite to the reinforcing bars with regard to the reinforcing bars of the portion at which the reinforcing bars are bound by the wire. However, in the state in which the one end and the other end of the wire after the binding are directed to the side opposite to the reinforcing bars, the wire binding the reinforcing bars has such a form that distal end portions of the wire are projected to be greater than a twisted region of the wire, and hence there is a fear of interfering with work.

In contrast, a technique for bending a distal end of a wire to a reinforcing bar side without projecting the distal end of the wire is disclosed in Patent Literature 2.

A technique for bending an end of a wire in a twisting direction is disclosed in Patent Literature 3.

CITATION LIST

Patent Literature

[Patent Literature 1]: Japanese Patent No. 4747455
[Patent Literature 2]: Japanese Patent No. 4570972
[Patent Literature 3]: Japanese Patent No. 5674762

SUMMARY

Technical Problem

However, specific means relevant to how and in which direction the wire is bent is not disclosed in any of Patent Literatures 2 and 3. Therefore, there is a fear that, even when the wire is made to be bent such that the end portions of the wire are located closer to a binding part than the top of the wire, a direction in which the wire is bent is not fixed in a desired direction, and the wire cannot be reliably bent such that the end portions of the wire are directed to the reinforcing bar side.

The present invention has been made to solve such problems, and an object thereof is to provide a binding machine that is made to reliably bend wires in a desired direction such that end portions of the wires are located closer to binding objects than the top portions of the wires.

Solution to Problem

In order to solve the above-mentioned problems, the present invention provides a binding machine which includes: a feeding unit that is capable for winding wires around binding objects; a gripping unit that grips the wires wound around the binding objects by the feeding unit; and a bending unit that bends the wires such that end portions of the wires gripped by the gripping unit are located closer to the binding objects than top portions of the wires.

Advantageous Effects of the Invention

In the present invention, a bending unit for bending wires such that end portions of the wires gripped by a gripping unit are located closer to a binding object than the top of the wire is provided, and thereby the wire can be reliably bent such that the end portions of the wire are located closer to the binding objects than the top of the wire.

DETAILED DESCRIPTION

Hereinafter, an example of a reinforcing bar binding machine as an embodiment of a binding machine of the present invention will be described with reference to the drawings.

Figure 1:
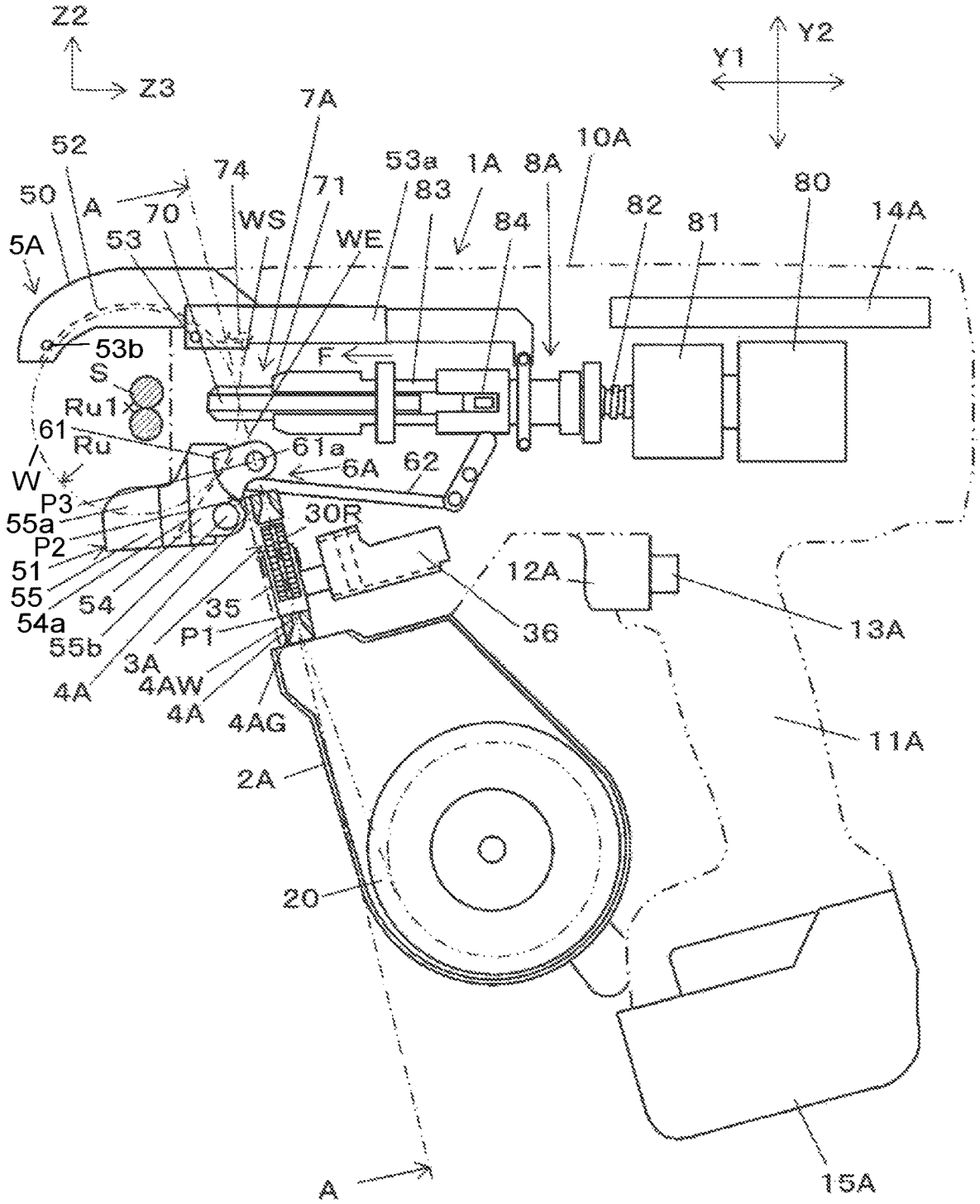
FIG. 1 is a view of an example of an overall configuration of a reinforcing bar binding machine of the present embodiment as viewed from the side.
Figure 2:
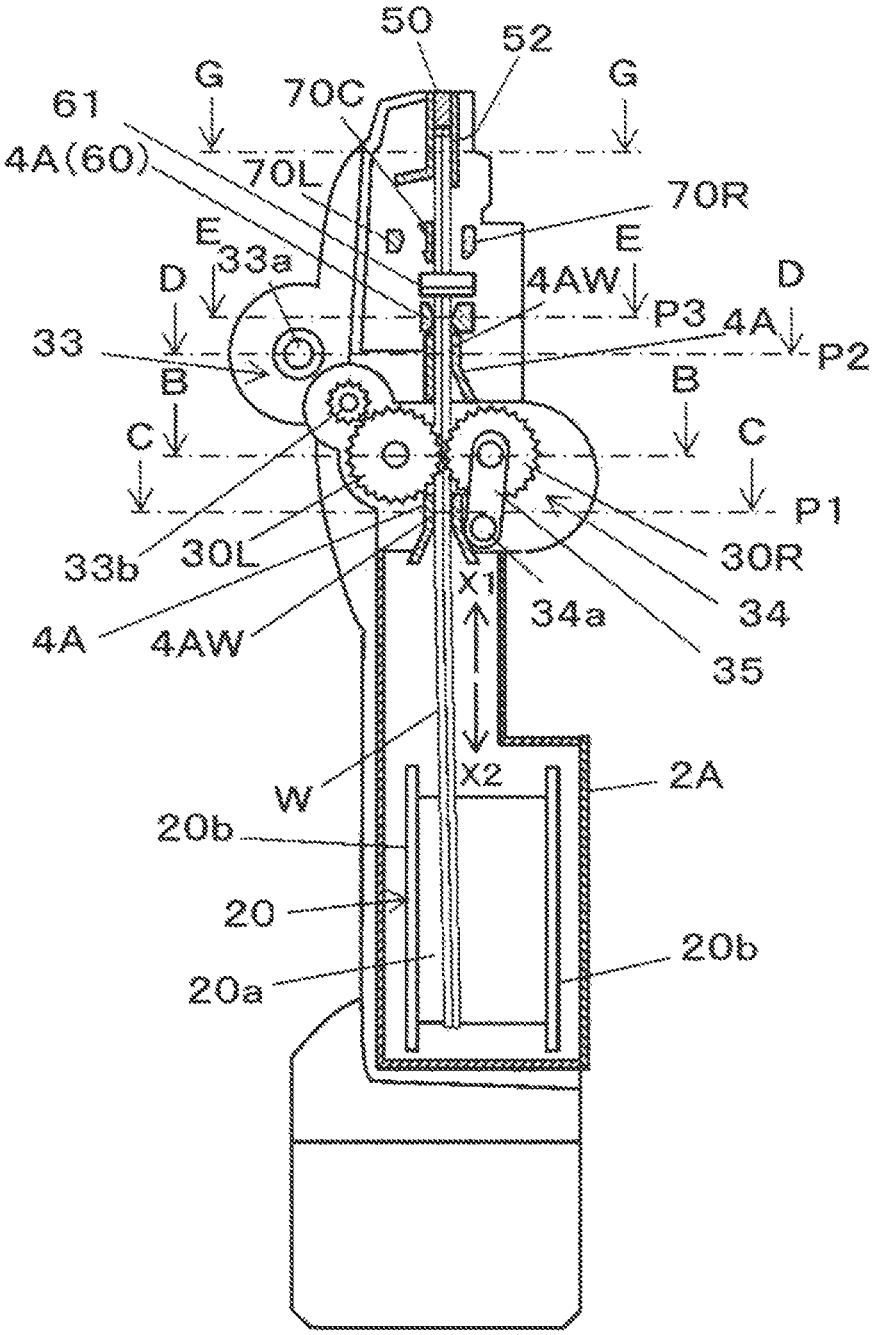
FIG. 2 is a view illustrating an example of the overall configuration of the reinforcing bar binding machine of the present embodiment as viewed from the front.

Example of Configuration of Reinforcing Bar Binding Machine of the Embodiment FIG. 1 is a view of an example of the overall configuration of a reinforcing bar binding machine according to the present embodiment as seen from a side, and FIG. 2 is a view illustrating an example of the overall configuration of the reinforcing bar binding machine of the present embodiment as seen from a front. Here, FIG. 2 schematically illustrates the internal configuration of the line A-A in FIG. 1.

As illustrated in FIG. 1, the reinforcing bar binding machine 1A of the present embodiment is a portable binding machine that can be carried. The reinforcing bar binding machine 1A binds reinforcing bars S, which are binding objects, using two or more wires W having a small diameter compared to a conventional wire having a large diameter. In the reinforcing bar binding machine 1A, as will be described below, the reinforcing bars S are bound with the wires W by an operation of winding the wires W around the reinforcing bars S, an operation of winding the wires W wound around the reinforcing bars S to come into close contact with the reinforcing bars S, an operation of twisting the wires wound around the reinforcing bars S, and so on. In the reinforcing bar binding machine 1A, since the wires W are bent by any of the operations described above, the wires W having a smaller diameter than the conventional wire are used. Thereby, the wires can be wound around the reinforcing bars S with a weak force, and the wires W can be twisted with a weak force. Two or more wires are used, and thereby binding strength of the reinforcing bars S can be secured by the wires W. Further, the two or more wires W are configured to be arranged and fed in parallel, and thereby a time required for the operation of winding the wires W can be shortened compared to an operation of winding the reinforcing bars twice or more with one wire. Winding the wires W around the reinforcing bars S and winding the wires W wound around the reinforcing bars S to come into close contact with the reinforcing bars S are collectively referred to as winding the wires W. The wires W may be wound around binding objects other than the reinforcing bars S. Here, as the wires W, a single wire or a stranded wire formed of a metal that can be plastically deformed is used.

The reinforcing bar binding machine 1A includes a magazine 2A that is a housing unit that houses the wire W, a wire feeding unit 3A that feeds the wire W housed in the magazine 2A, a parallel guide 4A for arranging the wires W fed to the wire feeding unit 3A and the wires W fed out from the wire feeding unit 3A in parallel. The reinforcing bar binding machine 1A further includes a curl guide unit 5A that winds the wires W fed out in parallel around the reinforcing bar S, and a cutting unit 6A that cuts the wire W wound around the reinforcing bar S. Further, the reinforcing bar binding machine 1A includes a binding unit 7A that grips and twists the wire W wound around the reinforcing bar S.

The magazine 2A is an example of a housing unit. In the embodiment, a reel 20 in which two long wires W are wound in a drawable manner is detachably housed. The reel 20 is provided with a tubular hub portion 20*a* that can wind the wires W and a pair of flanges 20*b* that are provided at opposite end sides of the hub portion 20*a* in an axial direction. The flanges 20*b* have a larger diameter than the hub portion 20*a*, and protrudes beyond the opposite end sides of the hub portion 20*a* in the axial direction. Two or more wires W, in this example, two wires W are wound around the hub portion 20*a*. In the reinforcing bar binding machine 1A, while the reel 20 housed in the magazine 2A rotates, the two wires W are fed out from the reel 20 through the operation of feeding the two wires W by the wire feeding unit 3A and the operation of feeding the two wires W manually. At this time, the two wires W are wound around the core portion 24 so that the two wires W are fed out without being twisted.

The wire feeding unit 3A is an example of a wire feeding unit constituting a feeding unit and includes a first feed gear 30L and a second feed gear 30R as a pair of feeding members for feeding the parallel wires W, the first feed gear 30L has a spur gear shape which feeds the wire W by a rotation operation, and the second feed gear 30R also has a spur gear shape which sandwiches the wire W with the first feed gear 30L. Although the details of the first feed gear 30L and the second feed gear 30R will be described later, the first feed gear 30L and the second feed gear 30R have a spur gear shape in which teeth are formed on the outer peripheral surface of a disk-like member. Although, the first feed gear 30L and the second feed gear 30R are meshed with each other, and the driving force is transmitted from one feed gear to the other feed gear, so that the two wires W can be appropriately fed, other drive arrangements could be used and the arrangement is not necessarily limited to use of a spur gear.

The first feed gear 30L and the second feed gear 30R are each formed of a disk-shaped member. In the wire feeding unit 3A, the first feed gear 30L and the second feed gear 30R are provided so as to sandwich the feed path of the wire W, so that the outer peripheral surfaces of the first feed gear 30L and the second feed gear 30R face each other. The first feed gear 30L and the second feed gear 30R sandwich the two parallel wires W between portions opposing to the outer peripheral surface. The first feed gear 30L and the second feed gear 30R feed two wires W along the extending direction of the wire W in a state where the two wires W are arranged in parallel with each other.

Figure 3:
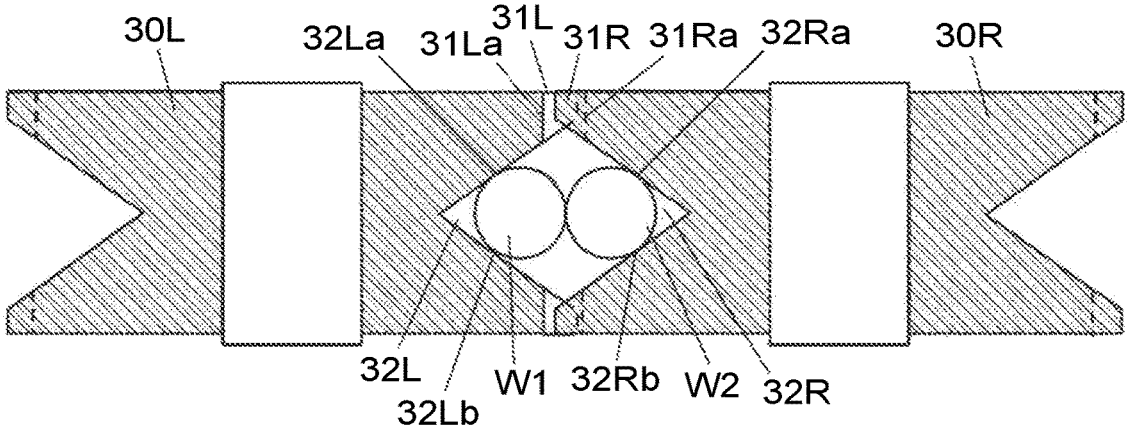
FIG. 3 is a view illustrating an example of a feed gear according to the present embodiment.

FIG. 3 is an assembly or operational view illustrating an example of the feed gear of this embodiment. FIG. 3 is a sectional view taken along the line B-B of FIG. 2. The first feed gear 30L includes a tooth portion 31L on its outer peripheral surface. The second feed gear 30R includes a tooth portion 31R on its outer peripheral surface.

The first feed gear 30L and the second feed gear 30R are arranged in parallel with each other so that the teeth portions 31L and 31R face each other. In other words, the first feed gear 30L and the second feed gear 30R are arranged in parallel in a direction along the axial direction Ru1 of a loop Ru formed by the wire W wound by the curl guide unit 5A, that is, along the axial direction of the virtual circle in which the loop Ru formed by the wire W is regarded as a circle. In the following description, the axial direction Ru1 of the loop Ru formed by the wire W wound by the curl guide unit 5A is also referred to as the axial direction Ru1 of the loop-shaped wire W.

The first feed gear 30L includes a first feed groove 32L on its outer peripheral surface. The second feed gear 30R includes a second feed groove 32R on its outer peripheral surface. The first feed gear 30L and the second feed gear 30R are arranged such that the first feed groove 32L and the second feed groove 32R face each other and the first feed groove 32L and the second feed groove 32R form a pinching portion.

The first feed groove 32L is formed in a V-groove shape on the outer peripheral surface of the first feed gear 30L along the rotation direction of the first feed gear 30L. The first feed groove 32L has a first inclined surface 32La and a second inclined surface 32Lb forming a V-shaped groove. The first feed groove 32L has a V-shaped cross section so that the first inclined surface 32La and the second inclined surface 32Lb face each other at a predetermined angle. When the wires W are held between the first feed gear 30L and the second feed gear 30R in parallel, the first feed groove 32L is configured such that one wire among the outermost wires of the wires W arranged in parallel, in this example, a part of the outer peripheral surface of one wire W1 of the two wires W arranged in parallel is in contact with the first inclined surface 32La and the second inclined surface 32Lb.

The second feed groove 32R is formed in a V-groove shape on the outer peripheral surface of the second feed gear 30R along the rotation direction of the second feed gear 30R. The second feed groove 32R has a first inclined surface 32Ra and a second inclined surface 32Rb that form a V-shaped groove. Similarly to the first feed groove 32L, the second feed groove 32R has a V-shaped cross-sectional shape, and the first inclined surface 32Ra and the second inclined surface 32Rb face each other at a predetermined angle. When the wire W is held between the first feed gear 30L and the second feed gear 30R in parallel, the second feed groove 32R is configured such that, the other wire among the outermost wires of the wires W arranged in parallel, in this example, a part of the outer peripheral surface of the other wire W2 of the two wires W arranged in parallel is in contact with the first inclined surface 32Ra and the second inclined surface 32Rb.

When the wire W is pinched between the first feed gear 30L and the second feed gear 30R, the first feed groove 32L is configured with a depth and an angle (between the first inclined surface 32La and the second inclined surface 32Lb) such that a part, on the side facing the second feed gear 30R, of one wire W1 in contact with the first inclined surface 32La and the second inclined surface 32Lb protrudes from the tooth bottom circle 31La of the first feed gear 30L.

When the wire W is pinched between the first feed gear 30L and the second feed gear 30R, the second feed groove 32R is configured with a depth and an angle (between the first inclined surface 32Ra and the second inclined surface 32Rb) such that a part, on the side facing the first feed gear 30L, of the other wire W2 in contact with the first inclined surface 32Ra and the second inclined surface 32Rb protrudes from the tooth bottom circle 31Ra of the second feed gear 30R.

As a result, the two wires W pinched between the first feed gear 30L and the second feed gear 30R are arranged such that one wire W1 is pressed against the first inclined surface 32La and the second inclined surface 32Lb of the first feed groove 32L, and the other wire W2 is pressed against the first inclined surface 32Ra and the second inclined surface 32Rb of the second feeding groove 32R. Then, one wire W1 and the other wire W2 are pressed against each other. Therefore, by rotation of the first feed gear 30L and the second feed gear 30R, the two wires W (one wire W1 and the other wire W2) are simultaneously fed between the first feed gear 30L and the second feed gear 30R while being in contact with each other. In this example, the first feed groove 32L and the second feed groove 32R have a V-shaped cross-sectional shape, but it is not necessarily limited to the V-groove shape, and it may be, for example, a trapezoidal shape or an arcuate shape. Further, in order to transmit the rotation of the first feed gear 30L to the second feed gear 30R, between the first feed gear 30L and the second feed gear 30R, a transmission mechanism including an even number of gears or the like for rotating the first feed gear 30L and the second feed gear 30R in opposite directions to each other may be provided.

The wire feeding unit 3A includes a driving unit 33 for driving the first feed gear 30L and a displacement unit 34 for pressing and separating the second feed gear 30R against the first feed gear 30L.

The driving unit 33 includes a feed motor 33*a* for driving the first feed gear 30L and a transmission mechanism 33*b* including a combination of a gear and the like for transmitting the driving force of the feed motor 33*a* to the first feed gear 30L.

In the first feed gear 30L, the rotation operation of the feed motor 33*a* is transmitted via the transmission mechanism 33*b* and the first feed gear 30L rotates. In the second feed gear 30R, the rotation operation of the first feed gear 30L is transmitted to the tooth portion 31R via the tooth portion 31L and the second feed gear 30R rotates in accordance with the first feed gear 30L.

As a result, by the rotation of the first feed gear 30L and the second feed gear 30R, due to the frictional force generated between the first feed gear 30L and the one wire W1, the friction force generated between the second feed gear 30R and the other wire W2, and the frictional force generated between the one wire W1 and the other wire W2, the two wires W are fed in a state of being arranged in parallel with each other.

By switching the forward and backward directions of the rotation direction of the feed motor 33*a*, the wire feeding unit 3A switches the direction of rotation of the first feed gear 30L and the direction of rotation of the second feed gear 30R, and the forward and reverse of the feeding direction of the wire W are switched.

In the reinforcing bar binding machine 1A, by forward rotation of the first feed gear 30L and the second feed gear 30R in the wire feeding unit 3A, the wire W is fed in the forward direction indicated by the arrow X1, that is, in the direction of the curl guide unit 5A and is wound around the reinforcing bar S at the curl guide unit 5A. Further, after the wire W is wound around the reinforcing bar S, the first feed gear 30L and the second feed gear 30R are reversely rotated, whereby the wire W is fed in the backward direction indicated by the arrow X2, that is, in the direction of the magazine 2A (pulled back). The wire W is wound around the reinforcing bar S and then pulled back, whereby the wire W is brought into close contact with the reinforcing bar S.

The displacement unit 34 includes a first displacement member 35 that displaces the second feed gear 30R in a direction in which the second feed gear 30R is brought into close contact and separated with/from the first feed gear 30L in the rotation operation with the shaft 34*a* as a fulcrum and a second displacement member 36 that displaces the first displacement member 35. The second feed gear 30R is pressed in the direction of the first feed gear 30L by a spring, not shown, that biases the second displacement member 36. Thus, in this example, the two wires W are held between the first feed groove 32L of the first feed gear 30L and the second feed groove 32R of the second feed gear 30R. Further, the tooth portion 31L of the first feed gear 30L and the tooth portion 31R of the second feed gear 30R mesh with each other. Here, in the relationship between the first displacement member 35 and the second displacement member 36, by displacing the second displacement member 36 to bring the first displacement member 35 into a free state, the second feed gear 30R can be separated from the first feed gear 30L. However, the first displacement member 35 and the second displacement member 36 may be interlocked with each other.

Figure 4A:
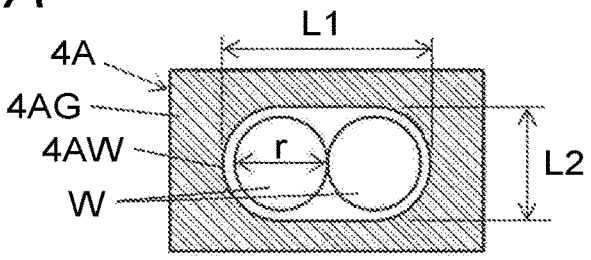
FIG. 4A is a view illustrating an example of a parallel guide of the present embodiment.
Figure 4B:
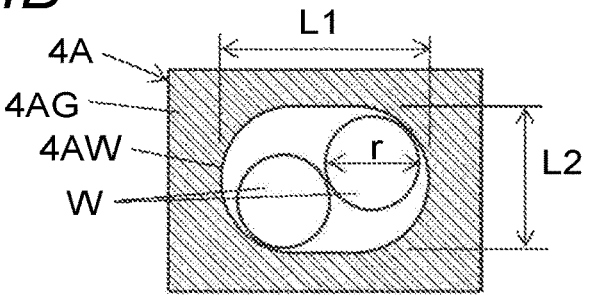
FIG. 4B is a view illustrating an example of the parallel guide of the present embodiment.
Figure 4C:
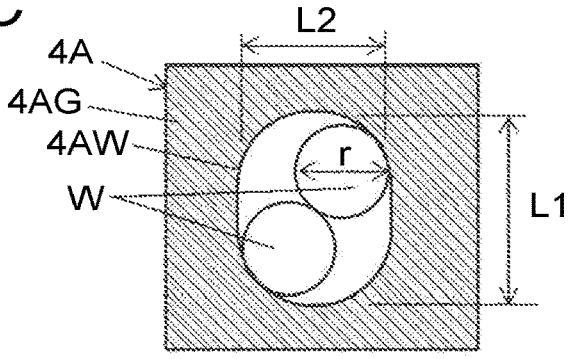
FIG. 4C is a view illustrating an example of the parallel guide of the present embodiment.
Figure 4D:
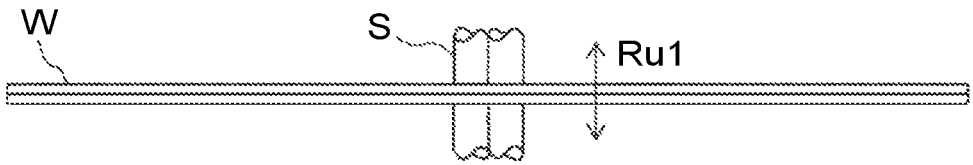
FIG. 4D is a view illustrating an example of parallel wires.
Figure 4E:
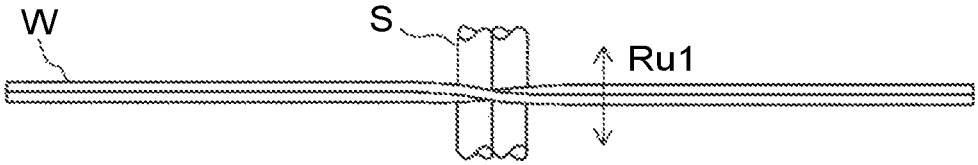
FIG. 4E is a view illustrating an example of intersected and twisted wires.

FIGS. 4A, 4B, and 4C are views illustrating an example of a parallel guide according to the present embodiment. Here, FIGS. 4A, 4B, and 4C are cross-sectional views taken along a line C-C of FIG. 2 and show the cross sectional shape of the parallel guide 4A provided at the introduction position P1. Further, the cross-sectional view taken along a line D-D of FIG. 2 illustrating the sectional shape of the parallel guide 4A provided at the intermediate position P2, and the cross-sectional view taken along a line E-E of FIG. 2 illustrating the sectional shape of the parallel guide 4A provided at the cutting discharge position P3 show the same shape. Further, FIG. 4D is a view illustrating an example of parallel wires, and FIG. 4E is a view illustrating an example of twisted wires intersecting each other.

The parallel guide 4A is an example of a restricting unit constituting the feeding unit and restricts the direction of a plurality of (two or more) wires W that have been sent. Two or more wires W enter and the parallel guide 4A feeds the two or more wires W in parallel. In the parallel guide 4A, two or more wires are arranged in parallel along a direction orthogonal to the feeding direction of the wire W. Specifically, two or more wires W are arranged in parallel along the axial direction of the loop-like wire W wound around the reinforcing bar S by the curl guide unit 5A. The parallel guide 4A has a wire restricting unit (for example, an opening 4AW described later) that restricts the directions of the two or more wires W and makes them parallel. In this example, the parallel guide 4A has a guide main body 4AG, and the guide main body 4AG is formed with an opening 4AW which is the wire restricting unit for passing (inserting) a plurality of wires W. The opening 4AW penetrates the guide main body 4AG along the feeding direction of the wire W. When the plurality of sent wires W pass through the opening 4AW and after passing through the opening 4AW, the configuration or relative positioning thereof is determined so that the plurality of wires W are arranged in parallel (each of the plurality of wires W is aligned adjacent each other in a direction (radial direction) orthogonal to the feeding direction of the wire W (axial direction) and the axis of each of the plurality of wires W is substantially parallel to each other in the feeding direction). Therefore, the plurality of wires W that have passed through the parallel guide 4A go out from the parallel guide 4A in a state of being arranged in parallel. In this way, the parallel guide 4A restricts the movement of the wires and relative movement of the wires in the radial direction (restricting movement in the directions orthogonal to the feed direction) so that the two wires W are arranged in parallel. Therefore, in the opening 4AW, one direction orthogonal to the feeding direction of the wire W is longer than the other direction which is orthogonal to the feeding direction of the wire W orthogonal to the one direction. The opening 4AW has a longitudinal direction (in which two or more wires W can be juxtaposed) is disposed along a direction orthogonal to the feeding direction of the wire W, more specifically, along the axial direction of the wire W loop-shaped by the curl guide unit 5A. As a result, two or more wires W inserted through the opening 4AW are fed in parallel with each other in the feeding direction, with relative movement restricted. In addition, the wire is offset relative to the other wire in a direction orthogonal to the feeding direction of the wire W, and in the preferred example, axes of the wires are offset in the axial direction Ru1 of the loop of wire W.

In the following description, when describing the shape of the opening 4AW, a cross-sectional shape in a direction orthogonal to the feeding direction of the wire W will be described. The cross-sectional shape in the direction along the feeding direction of the wire W will be described in each case.

For example, when the opening 4AW (the cross section thereof) is a circle having a diameter equal to or more than twice of the diameter of the wire W, or the length of one side is substantially a square which is twice or more the diameter of the wire W, the two wires W passing through the opening 4AW are in a state where they can freely move in the radial direction.

If the two wires W passing through the opening 4AW can freely move in the radial direction within the opening 4AW, the direction in which the two wires W are arranged in the radial direction cannot be restricted, whereby the two wires W coming out from the opening 4AW might not be in parallel, might be twisted or could intersect or interfere with each other.

In view of this, the opening 4AW is formed such that the length in the one direction or dimension, that is, the length L1 in the longitudinal direction is set to be slightly (n) times longer than the diameter r of the wire W in the form in which the plurality (n) of wires W are arranged along the radial direction, and the length in the other direction, that is, the length L2 in the lateral direction is set to be slightly (n) times longer than the diameter r of one wire W. In the present example, the opening 4AW has a length L1 in the longitudinal direction slightly twice longer than a diameter r of the wires W, and a length L2 in the lateral direction slightly longer than a diameter r of one wire W. In the present embodiment, the parallel guide 4A is configured such that the longitudinal direction of the opening 4AW is linear and the lateral direction is arcuate, but the configuration is not limited thereto.

In the example illustrated in FIG. 4A, the length L2 in the lateral direction (or smaller width direction) of the parallel guide 4A is set to a length slightly longer than the diameter r of one wire W as a preferable length. However, since it is sufficient that the wire W comes off from the opening 4AW in a parallel state without intersecting or being twisted, in the configuration in which the longitudinal direction (L1 or longer width direction) of the parallel guide 4A is oriented along the axial direction Ru1 of the loop of the wire W wound around the reinforcing bar S at the curl guide unit 5A, the length L2 of the parallel guide 4A in the lateral direction, as illustrated in FIG. 4B, may be within a range from a length slightly longer than the diameter r of one wire W to a length slightly shorter than the diameter r of two wires W.

Further, in the configuration in which the longitudinal direction of the parallel guide 4A is oriented in a direction orthogonal to the axial direction Ru1 of the loop of the wire W wound around the reinforcing bar S in the curl guide unit 5A, as illustrated in FIG. 4C, the length L2 in the lateral direction of the parallel guide 4A may be within a range from a length slightly longer than the diameter r of one wire W to a length shorter than the diameter r of two wires W.

In the parallel guide 4A, the longitudinal direction of the opening 4AW is oriented along a direction orthogonal to the feeding direction of the wire W, in this example, along the axial direction Ru1 of the loop formed by the wire W wound around the reinforcing bar S in the curl guide unit 5A.

As a result, the parallel guide 4A can pass two wires in parallel along the axial direction Ru1 of the loop formed by the wire W.

In the parallel guide 4A, when the length L2 in the lateral direction of the opening 4AW is shorter than twice the diameter r of the wire W and slightly longer than the diameter r of the wire W, even if the length L1 in the longitudinal direction of the opening 4AW is sufficiently twice or more times longer than the diameter r of wire W, it is possible to feed the wires W in parallel.

However, the longer the length L2 in the lateral direction (for example, the length close to twice the diameter r of the wire W) and the longer the length L1 in the longitudinal direction, the wire W can further freely move in the opening 4AW. Then, the respective axes of the two wires W do not become parallel in the opening 4AW, and there is a high possibility that the wires W are twisted or intersect (interfere) each other after passing through the opening 4AW.

Therefore, it is preferable that the longitudinal length L1 of the opening 4AW is slightly longer than twice the diameter r of the wire W, and the length L2 in the lateral direction is also slightly longer than the diameter r of the wire W so that the two wires W are arranged in parallel in the feed direction and relative movement of the two wires is limited in directions orthogonal to the feed direction along the radial direction of the wire.

The parallel guide 4A is provided at predetermined positions on the upstream side and the downstream side of the first feed gear 30L and the second feed gear 30R (the wire feeding unit 3A) with respect to the feeding direction for feeding the wire W in the forward direction. By providing the parallel guide 4A on the upstream side of the first feed gear 30L and the second feed gear 30R, the two wires W in a parallel state enter the wire feeding unit 3A. Therefore, the wire feeding unit 3A can feed the wire W appropriately (in parallel). Furthermore, by providing the parallel guide 4A also on the downstream side of the first feed gear 30L and the second feed gear 30R, while maintaining the parallel state of the two wires W sent from the wire feeding unit 3A, the wire W can be further sent to the downstream side.

The parallel guides 4A provided on the upstream side of the first feed gear 30L and the second feed gear 30R are provided at the introduction position P1 between the first feed gear 30L and the second feed gear 30R and the magazine 2A such that the wires W fed to the wire feeding unit 3A are arranged in parallel in a predetermined direction.

One of the parallel guides 4A provided on the downstream side of the first feed gear 30L and the second feed gear 30R is provided at the intermediate position P2 between the first feed gear 30L and the second feed gear 30R and the cutting unit 6A such that the wires W fed to the cutting unit 6A are arranged in parallel in the predetermined direction.

Further, the other one of the parallel guides 4A provided on the downstream side of the first feed gear 30L and the second feed gear 30R is provided at the cutting discharge position P3 where the cutting unit 6A is disposed such that the wires W fed to the curl guide unit 5A are arranged in parallel in the predetermined direction.

The parallel guide 4A provided at the introduction position P1 has the above-described shape in which at least the downstream side of the opening 4AW restricts the radial direction of the wire W with respect to the feeding direction of the wire W sent in the forward direction. On the other hand, the opening area of the side facing the magazine 2A (the wire introducing unit), which is the upstream side of the opening 4AW with respect to the feeding direction of the wire W sent in the forward direction, has a larger opening area than the downstream side. Specifically, the opening 4AW has a tube-shaped hole portion that restricts the direction of the wire W and a conical (funnel-shaped, tapered) hole portion in which an opening area gradually increases from the upstream side end of the tube-shaped hole portion to the inlet portion of the opening 4AW as the wire introducing portion. By making the opening area of the wire introducing portion the largest and gradually reducing the opening area therefrom, it is easy to allow the wire W to enter the parallel guide 4. Therefore, the work of introducing the wire W into the opening 4AW can be performed easily.

The other parallel guide 4A also has the same configuration, and the downstream opening 4AW with respect to the feeding direction of the wire W sent in the forward direction has the above-described shape that restricts the direction of the wire W in the radial direction. Further, with regard to the other parallel guide 4, the opening area of the opening on the upstream side with respect to the feeding direction of the wire W sent in the forward direction may be made larger than the opening area of the opening on the downstream side.

The parallel guide 4A provided at the introduction position P1, the parallel guide 4A provided at the intermediate position P2, and the parallel guide 4A provided at the cutting discharge position P3 are arranged such that the longitudinal direction (in the direction of L1) of the opening 4AW orthogonal to the feeding direction of the wire W is in the direction along the axial direction Ru1 of the loop of the wire W wound around the reinforcing bar S.

As a result, as illustrated in FIG. 4D, the two wires W sent by the first feed gear 30L and the second feed gear 30R are sent while maintaining a state of being arranged in parallel to the feed direction, with the two wires offset relative to each other in the axial direction Ru1 of the loop of the wire W wound around the reinforcing bar S, and, as illustrated in FIG. 4E, the two wires W are prevented from intersecting or interfering and being twisted during feeding.

In the present example, the opening 4AW is a tube-shaped hole having a predetermined depth (a predetermined distance or depth from the inlet to the outlet of the opening 4AW) from the inlet to the outlet of the opening 4AW (in the feeding direction of the wire W), but the shape of the opening 4AW is not limited to this. For example, the opening 4AW may be a planar hole having almost no depth with which the plate-like guide main body 4AG is opened. Further, the opening 4AW may be a groove-shaped guide (for example, a U-shaped guide groove with an opened upper portion) instead of the hole portion penetrating through the guide main body 4AG. Furthermore, in the present example, the opening area of the inlet portion of the opening 4AW as the wire introducing portion is made larger than the other portion, but it may not necessarily be larger than the other portion. The shape of the opening 4AW is not limited to a specific shape as long as the plurality of wires that have passed through the opening 4AW and come out of the parallel guide 4A are in a parallel state.

Hitherto, an example in which the parallel guide 4A is provided at the upstream side (introduction position P1) and a predetermined position (intermediate position P2 and cutting discharge position P3) on the downstream side of the first feed gear 30L and the second feed gear 30R is described. However, the position where the parallel guide 4A is installed is not necessarily limited to these three positions. That is, the parallel guide 4A may be installed only in the introduction position P1, only in the intermediate position P2, or only in the cutting discharge position P3, and only in the introduction position P1 and the intermediate position P2, only in the introduction position P1 and the cutting discharge position P3, or only in the intermediate position P2 and the cutting discharge position P3. Further, four or more parallel guides 4A may be provided at any position between the introduction position P1 and the curl guide unit 5A on the downstream side of the cutting position P3. The introduction position P1 also includes the inside of the magazine 2A. That is, the parallel guide 4A may be arranged in the vicinity of the outlet from which the wire W is drawn inside the magazine 2A.

The curl guide unit 5A is an example of a guide unit and constitutes a conveying path for winding the two wires W around the reinforcing bars S in a loop. The curl guide unit 5A includes a first guide unit 50 for curling the wire W sent by the first feed gear 30L and the second feed gear 30R and a second guide unit 51 for guiding the wire W fed from the first guide unit 50 to the binding unit 7A.

A tip of the first guide unit 50 and a tip of the second guide unit 51 are spaced apart from each other, and a predetermined gap (an opening) is formed in a feeding direction of the wires W. Therefore, when the binding operation of the reinforcing bars S is performed or completed, the reinforcing bars S can be put in and out through this gap. Among conventional reinforcing bar binding machines, there is a binding machine provided with a curl guide unit having a ring (a closed circle) shape without a gap (for example, the binding machine disclosed in Patent Literature 2 mentioned above). However, in this curl guide unit, a curl guide opening/closing mechanism for putting in and out the reinforcing bar S is required. In contrast, according to the curl guide unit 5A having the gap as in this example, there is no need to provide such a curl guide opening/closing mechanism.

Figure 5:
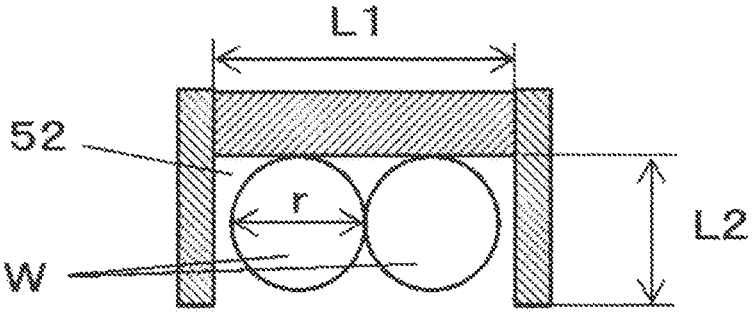
FIG. 5 is a view illustrating an example of a guide groove of the present embodiment.

The first guide unit 50 includes guide grooves 52 constituting a feed path of the wire W and guide pins 53 and 53*b* as a guide member for curling the wire W in cooperation with the guide groove 52. FIG. 5 is a view illustrating an example of the guide groove of the present embodiment. Here, FIG. 5 is a sectional view taken along the line G-G of FIG. 2.

The guide groove 52 is for guiding the wires W. In this example, to restrict a direction in the radial direction of the wires W which is orthogonal to the feeding direction of the wires W along with the parallel guide 4A, the guide groove 52 is configured by an opening having a shape in which one direction orthogonal to the feeding direction of the wires W is longer than another direction that is equally orthogonal to the feeding direction of the wires W and is orthogonal to the one direction.

The guide groove 52 has a longitudinal length L1 slightly twice or more times longer than the diameter r of one wire W in a form in which the wires W are arranged along the radial direction and a lateral length L2 slightly longer than the diameter r of one wire W. In the present embodiment, the length L1 in the longitudinal direction is slightly twice longer than the diameter r of the wire W. In the guide groove 52, the longitudinal direction of the opening is arranged in the direction along the axial direction Ru1 of the loop of the wire W. It should be noted that the guide groove 52 may not necessarily have the function of restricting the direction of the wire W in the radial direction. In that case, the dimension (length) in the longitudinal direction and in the lateral direction of the guide groove 52 is not limited to the above-described size.

The guide pin 53 is provided on the side of the introducing portion of the wire W that is fed by the first feed gear 30L and the second feed gear 30R in the first guide unit 50 and is arranged inside the loop Ru formed by the wire W in the radial direction with respect to the feed path of the wire W by the guide groove 52. The guide pin 53 restricts the feed path of the wire W so that the wire W fed along the guide groove 52 does not enter the inside of the loop Ru formed by the wire Win the radial direction.

The guide pin 53*b* is provided on the side of the discharge portion of the wire W which is fed by the first feed gear 30L and the second feed gear 30R in the first guide unit 50 and is arranged on the outer side in the radial direction of the loop Ru formed by the wire W with respect to the feed path of the wire W by the guide groove 52.

In the wire W sent by the first feed gear 30L and the second feed gear 30R, the radial position of the loop Ru formed by the wire W is restricted at least at three points including two points on the outer side in the radial direction of the loop Ru formed by the wire W and at least one point on the inner side between the two points, so that the wire W is curled.

In this example, the radially outer position of the loop Ru formed by the wire W is restricted at two points of the parallel guide 4A at the cutting discharge position P3 provided on the upstream side of the guide pin 53 with respect to the feeding direction of the wire W sent in the forward direction and the guide pin 53*b* provided on the downstream side of the guide pin 53. Further, the radially inner position of the loop Ru formed by the wire W is restricted by the guide pin 53.

The curl guide unit 5A includes a retreat mechanism 53*a* for allowing the guide pin 53 to retreat from a path through which the wire W moves by an operation of winding the wire W around the reinforcing bar S. After the wire W is wound around the reinforcing bar S, the retreat mechanism 53*a* is displaced in conjunction with the operation of the binding unit 7A, and retreats the guide pin 53 from the path where the wire W moves before the timing of winding the wire W around the reinforcing bar S.

The second guide unit 51 includes a fixed guide unit 54 as a third guide unit for restricting the radial position of the loop Ru (movement of the wire W in the radial direction of the loop Ru) formed by the wire W wound around the reinforcing bar S and a movable guide unit 55 serving as a fourth guide unit for restricting the position along the axial direction Ru1 of the loop Ru formed by the wire W wound around the reinforcing bar S (movement of the wire Win the axial direction Ru1 of the loop Ru).

The fixed guide unit 54 is provided with a wall surface 54*a* as a surface extending along the feeding direction of the wire W on the outer side in the radial direction of the loop Ru formed by the wire W wound around the reinforcing bar S. When the wire W is wound around the reinforcing bar S, the wall surface 54*a* of the fixed guide unit 54 restricts the radial position of the loop Ru formed by the wire W wound around the reinforcing bar S. The fixed guide unit 54 is fixed to the main body 10A of the reinforcing bar binding machine 1A, and the position thereof is fixed with respect to the first guide unit 50. The fixed guide unit 54 may be integrally formed with the main body 10A. In addition, in the configuration in which the fixed guide unit 54, which is a separate component, is attached to the main body 10A, the fixed guide unit 54 is not perfectly fixed to the main body 10A, but in the operation of forming the loop Ru may be movable to such an extent that movement of the wire W can be restricted.

The movable guide unit 55 is provided on the distal end side of the second guide unit 51 and includes a wall surface 55*a* that is provided on both sides along the axial direction Ru1 of the loop Ru formed by the wire W wound around the reinforcing bar S and is erected inward in the radial direction of the loop Ru from the wall surface 54*a*. When the wire W is wound around the reinforcing bar S, the movable guide unit 55 restricts the position along the axial direction Ru1 of the loop Ru formed by the wire W wound around the reinforcing bar S using the wall surface 55*a*. The wall surface 55*a* of the movable guide unit 55 has a tapered shape in which the gap of the wall surfaces 55*a* is spread at the tip side where the wire W sent from the first guide unit 50 enters and narrows toward the fixed guide unit 54*b*. As a result, the position of the wire W sent from the first guide unit 50 in the axial direction Ru1 of the loop Ru wound around the reinforcing bar S is restricted by the wall surface 55*a* of the movable guide unit 55, and guided to the fixed guide unit 54 by the movable guide unit 55.

The movable guide unit 55 is supported on the fixed guide unit 54 by a shaft 55*b* on the side opposite to the tip side into which the wire W sent from the first guide unit 50 enters. In the movable guide unit 55, the distal end side thereof into which the wire W fed from the first guide unit 50 enters is opened and closed in the direction to come into contact with and separate from the first guide unit 50 by the rotation operation of the loop Ru formed by the wire W wound around the reinforcing bar S along the axial direction Ru1 with the shaft 55*b* as a fulcrum.

In the reinforcing bar binding machine, when binding the reinforcing bar S, between a pair of guide members provided for winding the wire W around the reinforcing bar S, in this example, between the first guide unit 50 and the second guide unit 51, a reinforcing bar is inserted (set) and then the binding work is performed. When the binding work is completed, in order to perform the next binding work, the first guide unit 50 and the second guide unit 51 are pulled out from the reinforcing bar S after the completion of the binding. In the case of pulling out the first guide unit 50 and the second guide unit 51 from the reinforcing bar S, if the reinforcing bar binding machine 1A is moved in the direction of the arrow Z3 (see FIG. 1) which is one direction separating from the reinforcing bar S, the reinforcing bar S can be pulled out from the first guide unit 50 and the second guide unit 51 without any problem. However, for example, when the reinforcing bar S is arranged at a predetermined interval along the arrow Y2 and these reinforcing bars S are sequentially bound, moving the reinforcing bar binding machine 1A in the direction of the arrow Z3 every time of binding is troublesome, and if it can be moved in the direction of arrow Z2, the binding work can be performed quickly. However, in the conventional reinforcing bar binding machine disclosed in, for example, Japanese Patent No. 4747456, since the guide member corresponding to the second guide member 51 in the present example is fixed to the binding machine body, when trying to move the reinforcing bar binding machine in the direction of the arrow Z2, the guide member is caught on the reinforcing bar S. Therefore, in the reinforcing bar binding machine 1A, the second guide unit 51 (the movable guide unit 55) is made movable as described above and the reinforcing bar binding machine 1A is moved in the direction of the arrow Z2 so that the reinforcing bar S can be pulled out from between the first guide unit 50 and the second guide unit 51.

Therefore, the movable guide unit 55 rotates about the shaft 55*b* as a fulcrum, and thus opened and closed between a guide position at which the wire W sent out from the first guide unit 50 can be guided to the second guide unit 51 and a retreat position at which the reinforcing bar binding machine 1A moves in the direction of the arrow Z2 and then is retreated in the operation of pulling out the reinforcing bar binding machine 1A from the reinforcing bar S.

The movable guide unit 55 is biased by a biasing unit (not shown) such as a spring in a direction in which an interval between the distal end of the first guide unit 50 and the distal end of the second guide unit 51 is narrowed, and is held at the guide position by a force of the spring. In an operation of pulling out the reinforcing bar binding machine 1A from the reinforcing bars S, the movable guide unit 55 is pushed upon removal of to the reinforcing bars S, and thereby the movable guide unit 55 is opened from the guide position to the retreat position.

The cutting unit 6A includes a fixed blade unit 60, a rotary blade unit 61 for cutting the wire W in cooperation with the fixed blade unit 60, and a transmission mechanism 62 which transmits the operation of the binding unit 7A, in this example, the operation of a movable member 83 (to be described later) moving in a liner direction to the rotary blade unit 61 and rotates the rotary blade unit 61. The fixed blade unit 60 is configured by providing an edge portion capable of cutting the wire W in the opening through which the wire W passes. In the present example, the fixed blade unit 60 includes a parallel guide 4A arranged at the cutting discharge position P3.

The rotary blade unit 61 cuts the wire W passing through the parallel guide 4A of the fixed blade unit 60 by the rotation operation with the shaft 61*a* as a fulcrum. The transmission mechanism 62 is displaced in conjunction with the operation of the binding unit 7A, and after the wire W is wound around the reinforcing bar S, the rotary blade unit 61 is rotated according to the timing of twisting the wire W to cut the wire W.

The binding unit 7A is an example of a binding unit, and includes a gripping unit 70 that grips the wire W and a bending unit 71 configured to bend one end WS side and the other end WE side of the wire W gripped by the gripping unit 70 toward the reinforcing bar S.

The gripping unit 70 is an example of a gripping unit, and includes a fixed gripping member 70C, a first movable gripping member 70L, and a second movable gripping member 70R as illustrated in FIG. 2. The first movable gripping member 70L and the second movable gripping member 70R are arranged in the lateral direction via the fixed gripping member 70C. Specifically, the first movable gripping member 70L is disposed on one side along the axial direction of the wire W to be wound around, with respect to the fixed gripping member 70C, and the second movable gripping member 70R is disposed on the other side.

The first movable gripping member 70L is displaced in a direction to come into contact with and separate from the fixed gripping member 70C. In addition, the second movable gripping member 70R is displaced in a direction to come into contact with and separate from the fixed gripping member 70C.

As the first movable gripping member 70L moves in a direction away from the fixed gripping member 70C, in the gripping unit 70, a feed path through which the wire W passes between the first movable gripping member 70L and the fixed gripping member 70C is formed. On the other hand, as the first movable gripping member 70L moves toward the fixed gripping member 70C, the wire W is gripped between the first movable gripping member 70L and the fixed gripping member 70C.

When the second movable gripping member 70R moves in a direction away from the fixed gripping member 70C, in the gripping unit 70, a feed path through which the wire W passes between the second movable gripping member 70R and the fixed gripping member 70C is formed. On the other hand, as the second movable gripping member 70R moves toward the fixed gripping member 70C, the wire W is gripped between the second movable gripping member 70R and the fixed gripping member 70C.

The wire W sent by the first feed gear 30L and the second feed gear 30R and passed through the parallel guide 4A at the cutting discharge position P3 passes between the fixed gripping member 70C and the second movable gripping member 70R and is guided to the curl guide unit 5A. The wire W which has been wound by the curl guide unit 5A passes between the fixed gripping member 70C and the first movable gripping member 70L.

Therefore, a first gripping unit for gripping one end WS side of the wire W is constituted by the pair of grip members of the fixed gripping member 70C and the first movable gripping member 70L. Further, the fixed gripping member 70C and the second movable gripping member 70R constitute a second gripping unit for gripping the other end WE side of the wire W cut by the cutting unit 6A.

Figure 6A:
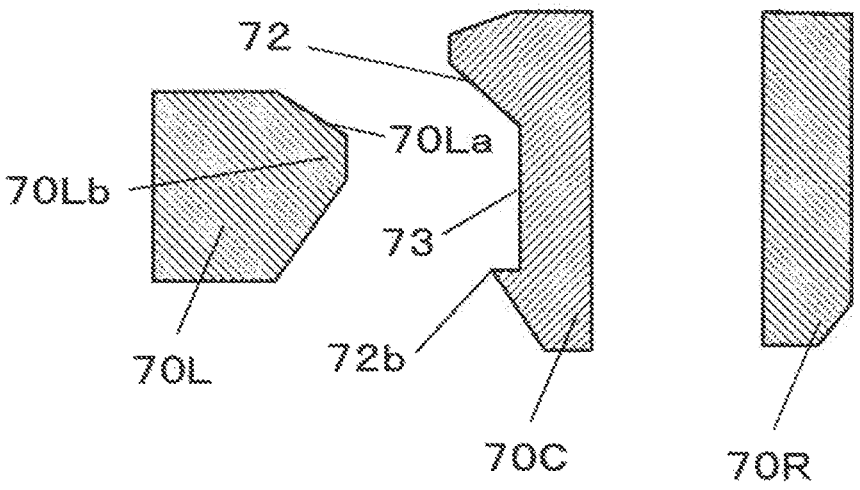
FIG. 6A is a view of major parts of a gripping unit of the present embodiment.
Figure 6B:
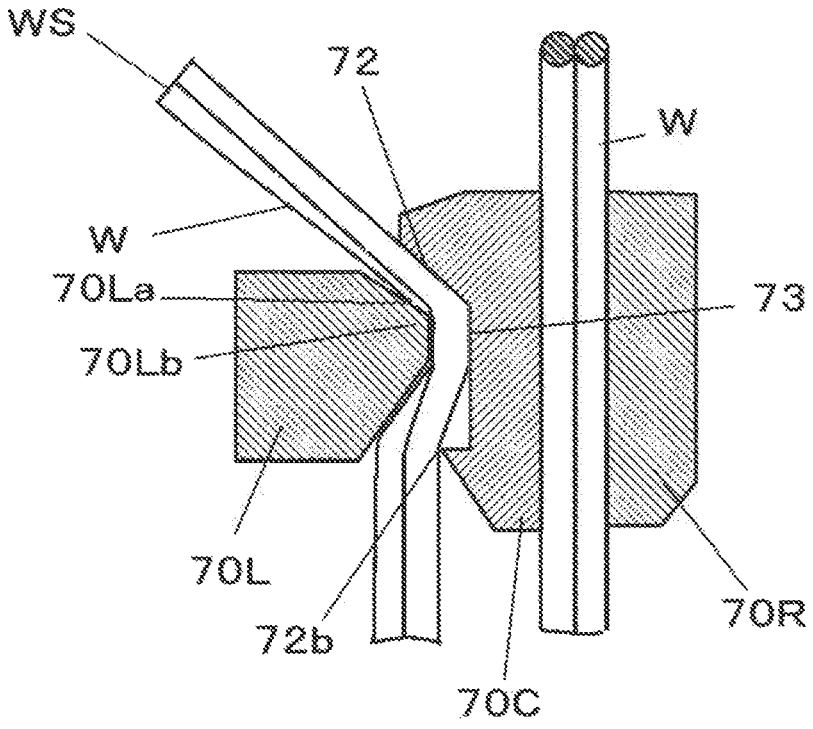
FIG. 6B is a view of the major parts of the gripping unit of the present embodiment.

FIGS. 6A and 6B are views illustrating main parts of the gripping unit of this embodiment. The first movable gripping member 70L includes a protrusion 70Lb protruding toward the fixed gripping member 70C on a surface facing the fixed gripping member 70C. On the other hand, the fixed gripping member 70C includes a recess 73, into which the protrusion 70Lb of the first gripping member 70L is inserted, on a surface facing the first movable gripping member 70L. Accordingly, when the wire W is gripped with the first movable gripping member 70L and the fixed gripping member 70C, the wire W is bent toward the first movable gripping member 70L.

To be specific, the fixed gripping member 70C includes a preliminary bending portion 72. The preliminary bending portion 72 is configured such that a protrusion protruding toward the first movable gripping member 70L is provided at a downstream end along the feeding direction of the wire W fed in the forward direction on the surface facing the first movable gripping member 70L of the fixed gripping member 70C.

In order to grip the wire W between the fixed gripping member 70C and the first movable gripping member 70L and prevent the gripped wire W from being pulled out, the gripping unit 70 has the protrusion portion 72*b* and the recess portion 73 on the fixed gripping member 70C. The protrusion portion 72*b* is provided on the upstream end along the feeding direction of the wire W fed in the forward direction on the surface facing the first movable gripping member 70L of the fixed gripping member 70C and protrudes to the first movable gripping member 70L. The recess portion 73 is provided between the preliminary bending portion 72 and the protrusion portion 72*b* and has a recess shape in a direction opposite to the first movable gripping member 70L.

The first movable gripping member 70L has a recess portion 70La into which the preliminary bending portion 72 of the fixed gripping member 70C enters and a protrusion portion 70Lb which enters the recess portion 73 of the fixed gripping member 70C.

As a result, as illustrated in FIG. 6B, by the operation of gripping one end WS side of the wire W between the fixed gripping member 70C and the first movable gripping member 70L, the wire W is pressed by the preliminary bending portion 72 on the first movable gripping member 70L side, and one end WS of the wire W is bent in a direction away from the wire W gripped by the fixed gripping member 70C and the second movable gripping member 70R.

Gripping the wire W with the fixed gripping member 70C and the second movable gripping member 70R includes a state in which the wire W can move freely to some extent between the fixed gripping member 70C and the second movable gripping member 70R. This is because, in the operation of winding the wire W around the reinforcing bar S, it is necessary to move the wire W between the fixed gripping member 70C and the second movable gripping member 70R.

The bending portion 71 is an example of a bending unit, and bends the wires W such that the end portions of the wires W after the wires W bind the binding objects are located closer to the binding objects than the top portions of the wires W that fully protrude (or protrude the most) in the direction separated from the binding objects. The bending portion 71 is provided with fulcrum parts (anti-slip parts to be described below) 75 and 76 that become fulcrums when the wires W are bent, and bending portions 71*a* and 71*b* that bend the wires W using the fulcrum parts 75 and 76 as the fulcrums (see FIG. 16). In this example, the bending portion 71 bends the wires W gripped by the gripping unit 70 before the wires W are twisted by the gripping unit 70.

The bending portions 71*a* and 71*b* are provided around the gripping unit 70 so as to cover a part of the gripping unit 70, and are provided so as to be movable along the axial direction of the gripping unit 70. Specifically, the bending portions 71*a* and 71*b* are configured to approach the one end WS side of each wire W gripped by the fixed gripping member 70C and the first movable gripping member 70L and the other end WE side of each wire W gripped by the fixed gripping member 70C and the second movable gripping member 70R, and are movable in the direction in which the one end WS side and the other end WE side of each wire W are bent and in the forward/backward direction that is the direction separated from the bent wires W.

The bending portion 71*a* moves in the forward direction indicated by an arrow F, and thereby bends the one end WS side of each wire W gripped by the fixed gripping member 70C and the first movable gripping member 70L to the reinforcing bar S side using the fulcrum part 75 located at the gripping position as the fulcrum. The bending portion 71*b* moves in the forward direction indicated by the arrow F, and thereby bends the other end WE side of each wire W between the fixed gripping member 70C and the second movable gripping member 70R to the reinforcing bar S side using the fulcrum part 76 located at the gripping position as the fulcrum.

The wire W is bent by the movement of the bending portions 71*a* and 71*b*, so that the wire W passing between the second movable gripping member 70R and the fixed gripping member 70C is pressed by the bending portion 71*b*, and the wire W is prevented from slipping out between the fixed gripping member 70C and the second movable gripping member 70R.

The binding unit 7A includes a length restricting unit 74 that restricts the position of one end WS of the wire W. The length restricting unit 74 is constituted by providing a member against which the one end WS of the wire W abuts in the feed path of the wire W that has passed between the fixed gripping member 70C and the first movable gripping member 70L. In order to secure a predetermined distance from the gripping position of the wire W by the fixed gripping member 70C and the first movable gripping member 70L, the length restricting unit 74 is provided in the first guide unit 50 of the curl guide unit 5A in this example.

The reinforcing bar binding machine 1A includes a binding unit driving mechanism 8A that drives the binding unit 7A. The binding unit driving mechanism 8A includes a motor 80, a rotary shaft 82 driven by the motor 80 via a speed reducer 81 that performs deceleration and torque amplification, a movable member 83 that is displaced by a rotation operation of the rotary shaft 82, and a rotation restricting member 84 that restricts the rotation of the movable member 83 interlocking with the rotation operation of the rotary shaft 82.

In the rotary shaft 82 and the movable member 83, by the screw portion provided on the rotary shaft 82 and the nut portion provided in the movable member 83, the rotation operation of the rotary shaft 82 is converted to the movement of the movable member 83 along the rotary shaft 82 in the forward and backward direction.

The movable member 83 is locked to the rotation restricting member 84 in the operation region where the wire W is gripped by the gripping unit 70, and then the wire W is bent by the bending portion 71, so that the movable member 83 moves in the forward and backward direction in a state where the rotation operation is restricted by the rotation restricting member 84. Further, the movable member 83 is rotated by the rotation operation of the rotary shaft 82 by coming off from the locking of the rotation restricting member 84.

In this example, the movable member 83 is connected to the first movable gripping member 70L and the second movable gripping member 70R via a cam (not illustrated). The binding unit driving mechanism 8A is configured so that the movement of the movable member 83 in the forward and backward direction is converted into the operation of displacing the first movable gripping member 70L in the direction to come into contact with and separate from the fixed gripping member 70C, and the operation of displacing the second movable gripping member 70R in the direction to come into contact with and separate from the fixed gripping member 70C.

Further, in the binding unit driving mechanism 8A, the rotation operation of the movable member 83 is converted into the rotation operation of the fixed gripping member 70C, the first movable gripping member 70L and the second movable gripping member 70R.

Furthermore, in the binding unit driving mechanism 8A, the bending portion 71 is provided integrally with the movable member 83, so that the bending portion 71 moves in the forward and backward direction by the movement of the movable member 83 in the forward and backward direction.

The retreat mechanism 53*a* of the guide pin 53 is configured by a link mechanism that converts the movement of the movable member 83 in the forward and backward direction into displacement of the guide pin 53. The transmission mechanism 62 of the rotary blade portion 61 is configured by a link mechanism that converts the movement of the movable member 83 in the forward and backward direction into the rotation operation of the rotary blade portion 61.

The reinforcing bar binding machine 1A according to the present embodiment has a form used by a worker in hand and includes a main body 10A and a handle portion 11A. The reinforcing bar binding machine 1A incorporates a binding unit 7A and a binding unit driving mechanism 8A in the main body 10A and has a curl guide unit 5A at one end side of the main body 10A in the longitudinal direction (first direction Y1). Further, the handle portion 11A is provided so as to protrude from the other end side in the longitudinal direction of the main body 10A to one direction (second direction Y2) substantially orthogonal (intersecting) with the longitudinal direction. Further, the wire feeding unit 3A is provided on the side along the second direction Y2 with respect to the binding unit 7A, and the magazine 2A is provided on the side along the second direction Y2 with respect to the wire feeding unit 3A.

Therefore, the magazine 2A is provided at one side along a first direction Y1 with respect to the handle part 11A. A trigger 12A is provided at one side of the handle part 11A in the first direction Y1, and the control unit 14A controls the feed motor 33*a* and the motor 80 according to the state of the switch 13A pressed by the operation of the trigger 12A. Further, a battery 15A is detachably attached to an end of the handle part 11A in a second direction Y2.

Example of Operation of Reinforcing Bar Binding Machine in the Embodiment

Figure 13:
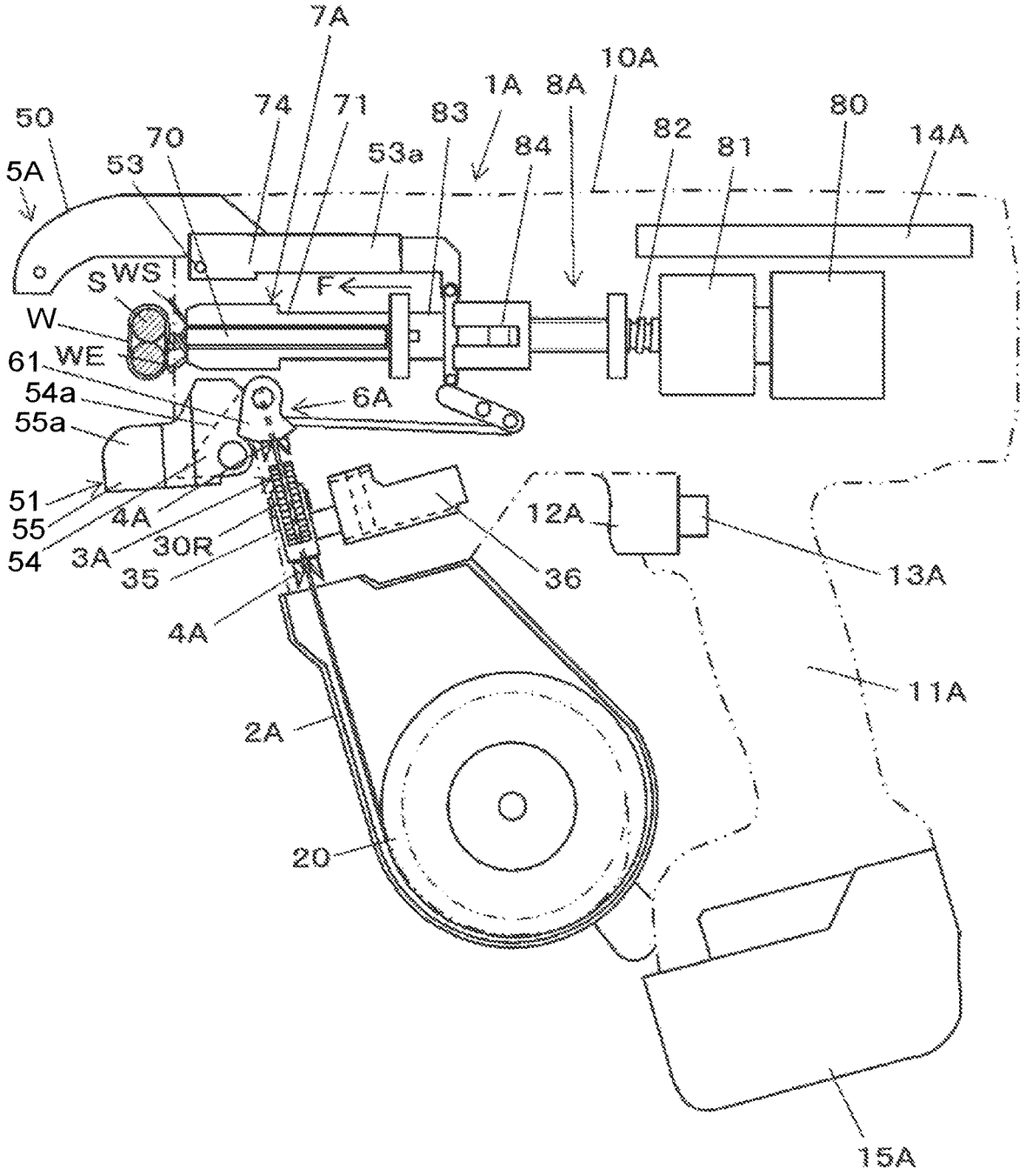
FIG. 13 is an explanatory view of an operation of the reinforcing bar binding machine of the present embodiment.
Figure 14:
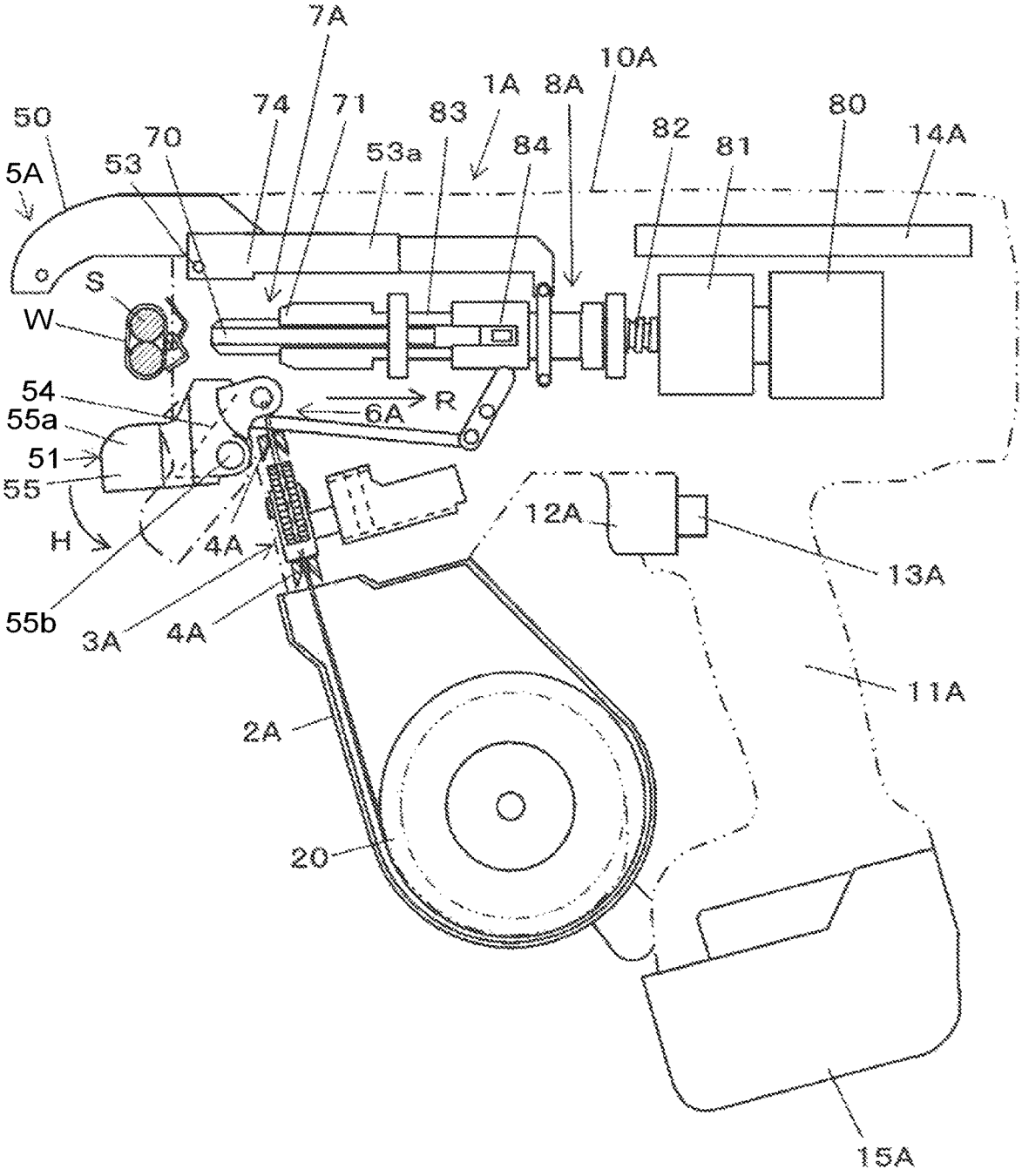
FIG. 14 is an explanatory view of an operation of the reinforcing bar binding machine of the present embodiment.
Figure 15A:
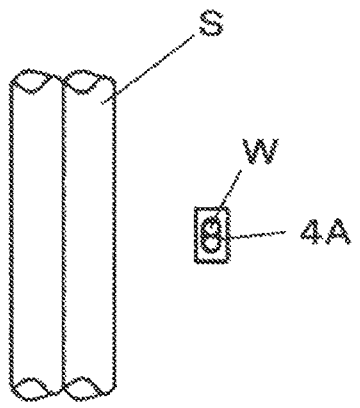
FIG. 15A is an explanatory view of an operation of winding a wire around reinforcing bars.
Figure 15B:
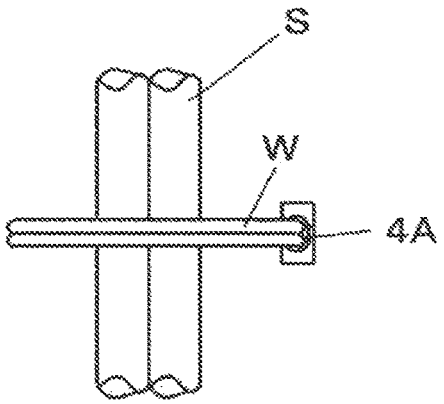
FIG. 15B is an explanatory view of an operation of winding the wire around the reinforcing bars.
Figure 15C:
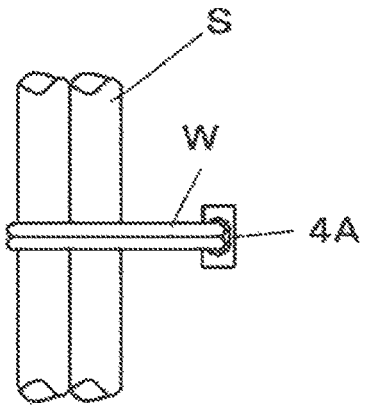
FIG. 15C is an explanatory view of an operation of winding the wire around the reinforcing bars.
Figure 16A:
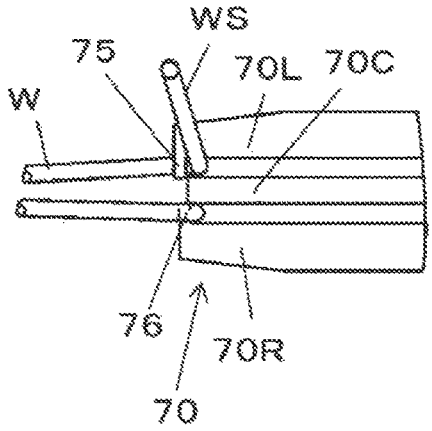
FIG. 16A is an explanatory view of an operation of bending a wire.
Figure 16B:
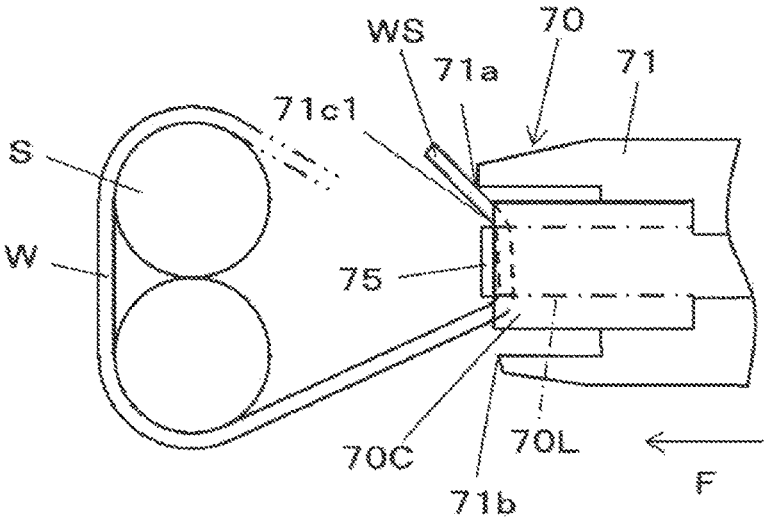
FIG. 16B is an explanatory view of an operation of bending the wire.
Figure 16C:
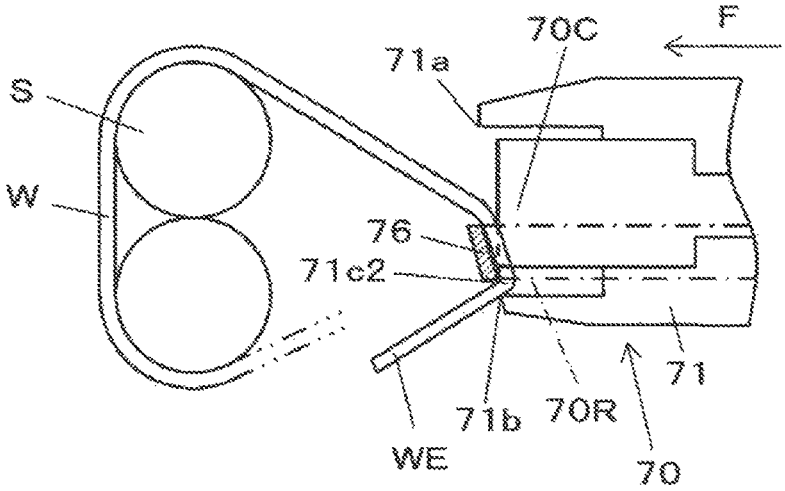
FIG. 16C is an explanatory view of an operation of bending the wire.

FIGS. 7 to 14 are diagrams for explaining the operation of the reinforcing bar binding machine 1A according to the present embodiment, and FIGS. 15A, 15B, and 15C are diagrams for explaining the operation of winding the wire around the reinforcing bar. FIGS. 16A, 16B, and 16C are explanatory views of the operation of bending the wire. Next, with reference to the drawings, the operation of binding the reinforcing bar S with the wire W by the reinforcing bar binding machine 1A of this embodiment will be described.

Figure 7:
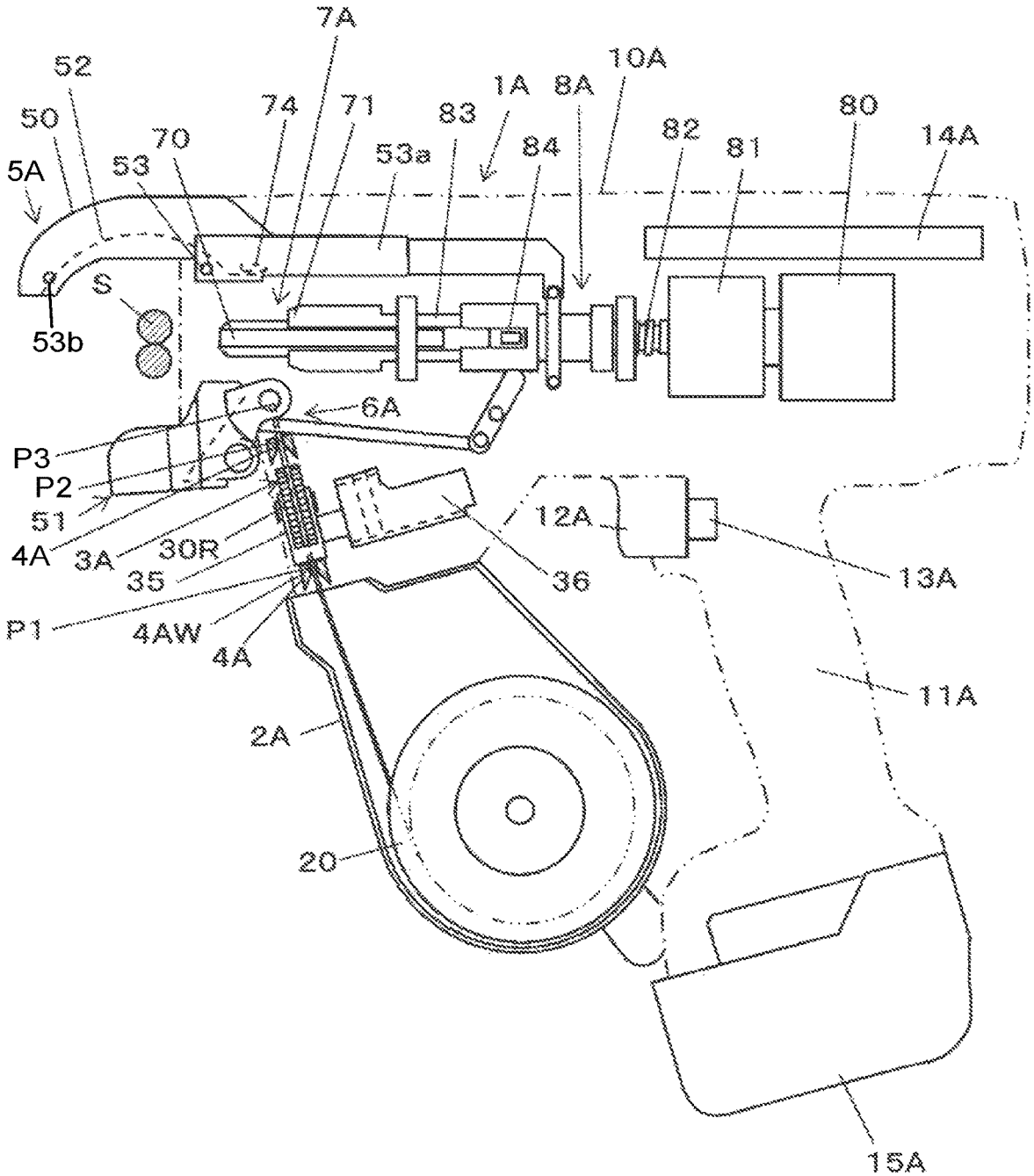
FIG. 7 is an explanatory view of an operation of the reinforcing bar binding machine of the present embodiment.

FIG. 7 illustrates the origin state, that is, the initial state in which the wire W has not yet been sent by the wire feeding unit 3A. In the origin state, the tip of the wire W stands by at the cutting discharge position P3. As illustrated in FIG. 15A, the wire W waiting at the cutting discharge position P3 is arranged in parallel in a predetermined direction by passing through the parallel guide 4A (fixed blade portion 60) in which the two wires W are provided at the cutting discharge position P3, in this example.

The wires W between the cutting discharge position P3 and the magazine 2A are arranged in parallel in a predetermined direction by the parallel guide 4A at the intermediate position P2 and the parallel guide 4A at the introduction position P1, the first feed gear 30L and the second feed gear 30R.

Figure 8:
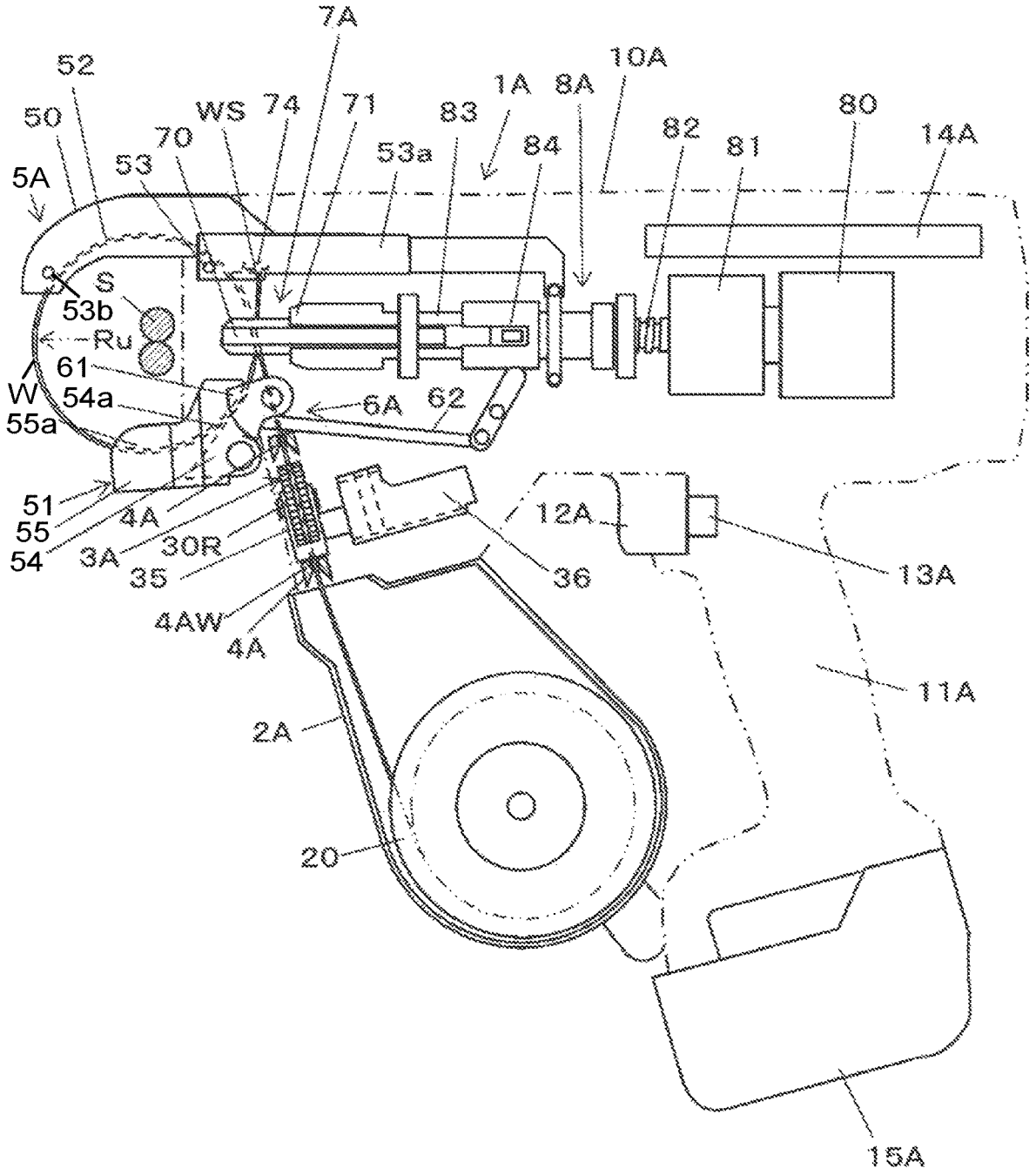
FIG. 8 is an explanatory view of an operation of the reinforcing bar binding machine of the present embodiment.

FIG. 8 illustrates a state in which the wire W is wound around the reinforcing bar S. When the reinforcing bar S is inserted between the first guide unit 50 and the second guide unit 51 of the curl guide unit 5A and the trigger 12A is operated, the feed motor 33*a* is driven in the normal rotation direction, and thus the first feed gear 30L rotates in forward direction and the second feed gear 30R rotates in the forward direction while following the first feed gear 30L.

Therefore, the two wires W are fed in the forward direction by the frictional force generated between the first feed gear 30L and the one wire W1, the frictional force generated between the second feed gear 30R and the other wire W2, and the frictional force generated between the one wire W1 and the other wire W2.

Two wires W entering between the first feed groove 32L of the first feed gear 30L and the second feed groove 32R of the second feed gear 30R, and two wires W discharged from the first feed gear 30L and the second feed gear 30R are fed in parallel with each other in a predetermined direction by providing the parallel guides 4A on the upstream side and the downstream side of the wire feeding unit 3A with respect to the feeding direction of the wire W fed in the forward direction.

When the wire W is fed in the forward direction, the wire W passes between the fixed gripping member 70C and the second movable gripping member 70R and passes through the guide groove 52 of the first guide unit 50 of the curl guide unit 5A. As a result, the wire W is curled so as to be wound around the reinforcing bar S. The two wires W introduced into the first guide unit 50 are held in a state of being arranged in parallel by the parallel guide 4A at the cutting discharge position P3. Further, since the two wires W are fed in a state of being pressed against the outer wall surface of the guide groove 52, the wires W passing through the guide groove 52 are also held in a state of being arranged in parallel in a predetermined direction.

The wire W fed from the first guide unit 50 is restricted to move along the axial direction Rut of the loop Ru formed by the wire to be wound therearound by the movable guide unit 55 of the second guide unit 51 to be guided to the fixed guide unit 54 by the wall surface 55*a* while being restricted/limited in its movement. In FIG. 8, the movement of the wire W along the radial direction of the loop Ru, which is guided to the fixed guide unit 54, is restricted by the wall surface 54*a* of the fixed guide unit 54, and the wire W is guided between the fixed gripping member 70C and the first movable gripping member 70L. Then, when the distal end of the wire W is fed to a position where it abuts against the length restricting unit 74, driving of the feed motor 33*a* is stopped.

As a result, the wire W is wound in a loop shape around the reinforcing bar S. At this time, as illustrated in FIG. 15B, the two wires W wound around the reinforcing bar S are held in a state in which they are arranged in parallel with each other without being twisted.

Figure 9:
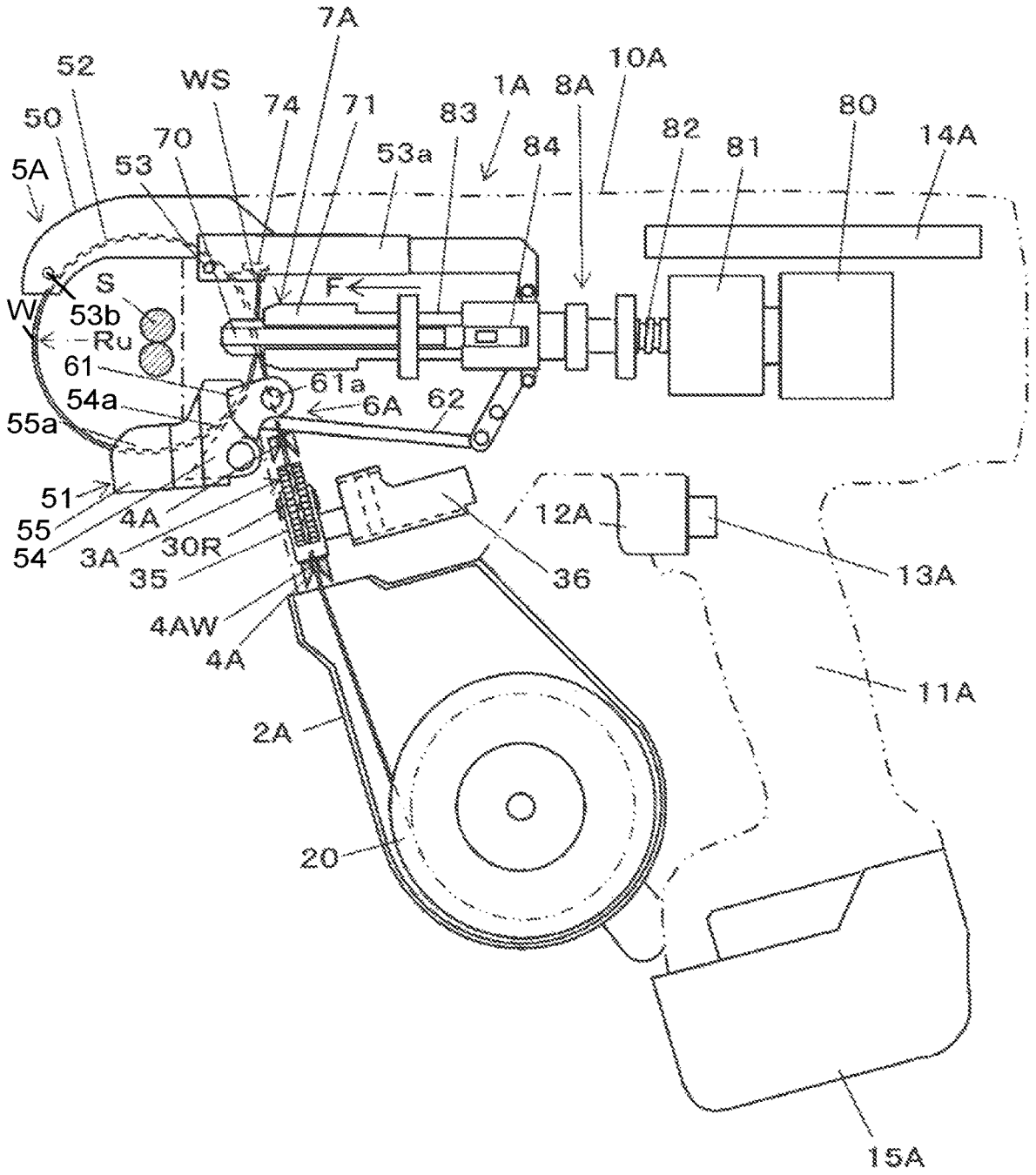
FIG. 9 is an explanatory view of an operation of the reinforcing bar binding machine of the present embodiment.

FIG. 9 illustrates a state where the wire W is gripped by the gripping unit 70. After stopping the feeding of the wire W, the motor 80 is driven in the normal rotation direction, whereby the motor 80 moves the movable member 83 in the direction of the arrow F which is the forward direction. That is, in the movable member 83, the rotation operation interlocked with the rotation of the motor 80 is restricted by the rotation restricting member 84, and the rotation of the motor 80 is converted into a linear movement. As a result, the movable member 83 moves in the forward direction. In conjunction with the operation of the movable member 83 moving in the forward direction, the first movable gripping member 70L is displaced in a direction approaching the fixed gripping member 70C, and one end WS side of the wire W is gripped.

Further, the operation of the movable member 83 moving in the forward direction is transmitted to the retreat mechanism 53*a*, and the guide pin 53 is retreated from the path through which the wire W moves.

Figure 10:
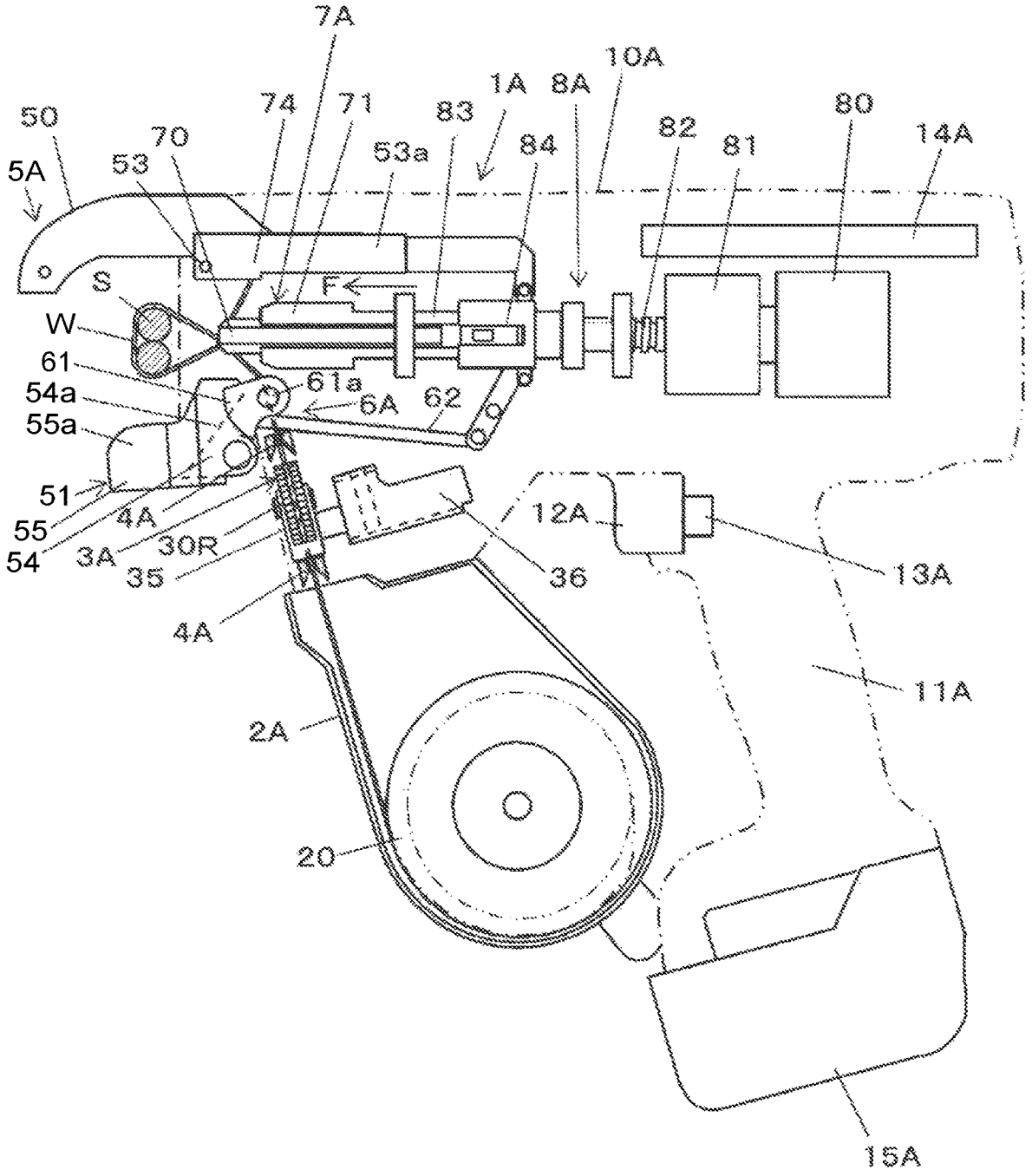
FIG. 10 is an explanatory view of an operation of the reinforcing bar binding machine of the present embodiment.

FIG. 10 illustrates a state where the wire W is wound around the reinforcing bar S. After the one end WS side of the wire W is gripped between the first movable gripping member 70L and the fixed gripping member 70C, and the feed motor 33*a* is driven in the reverse rotation direction, the first feed gear 30L rotates reversely and the second feed gear 30R rotates reversely following the first feed gear 30L.

Therefore, the two wires W are pulled back toward the magazine 2A and are fed in the opposite (backward) direction. In the operation of feeding the wire W in the backward direction, the wire W is wound so as to be in close contact with the reinforcing bar S. In this example, as illustrated in FIG. 15C, since two wires are arranged in parallel with each other, an increase in feed resistance due to twisting of the wires Win the operation of feeding the wire W in the opposite direction is suppressed. Further, in the case where the same binding strength is to be obtained between the case where the reinforcing bar S is bound with a single wire as in the conventional case and the case where the reinforcing bar S is bound with the two wires W as in this example, the diameter of each wire W can be made thinner by using two wires W. Therefore, it is easy to bend the wire W, and the wire W can be brought into close contact with the reinforcing bar S with a small force. Therefore, the wire W can be reliably wound around the reinforcing bar S in close contact with a small force. In addition, by using two thin wires W, it is easy to make the wire W in a loop shape, and it is also possible to reduce the load at the time of cutting the wire W. Along with this, it is possible to downsize each motor of the reinforcing bar binding machine 1A, and downsize the entire main body by downsizing the mechanical section. In addition, it is possible to reduce power consumption by reducing the size of the motor and reducing the load.

Figure 11:
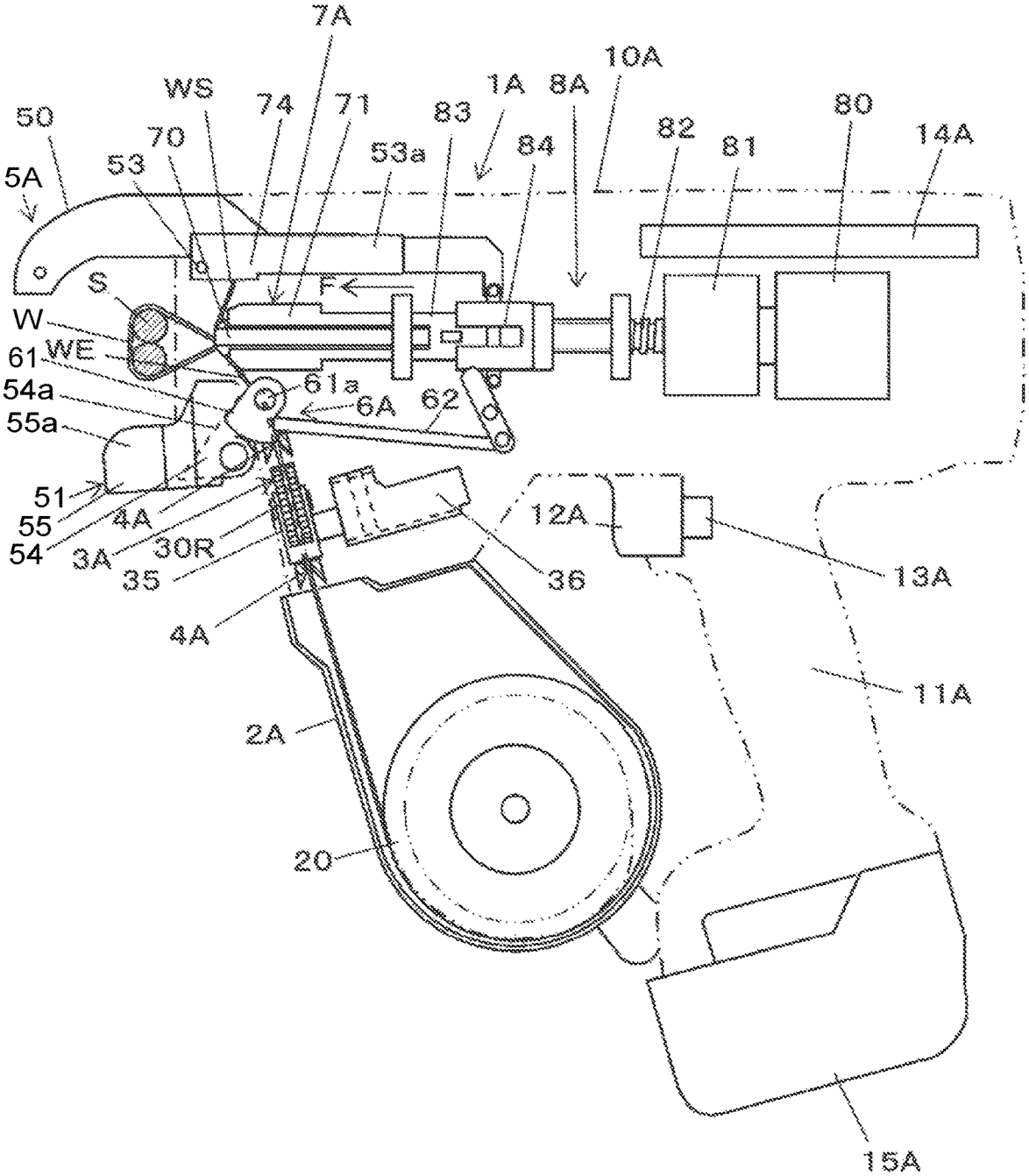
FIG. 11 is an explanatory view of an operation of the reinforcing bar binding machine of the present embodiment.

FIG. 11 illustrates a state in which the wire W is cut. After winding the wire W around the reinforcing bar S, and stopping the feeding of the wire W, the motor 80 is driven in the normal rotation direction, thereby moving the movable member 83 in the forward direction. In conjunction with the operation of the movable member 83 moving in the forward direction, the second movable gripping member 70R is displaced in a direction approaching the fixed gripping member 70C, and the wire W is gripped. In addition, the operation of the movable member 83 moving in the forward direction is transmitted to the cutting unit 6A by the transmission mechanism 62, and the other end WE side of the wire W gripped by the second movable gripping member 70R and the fixed gripping member 70C is cut by the operation of the rotary blade portion 61.

Figure 12:
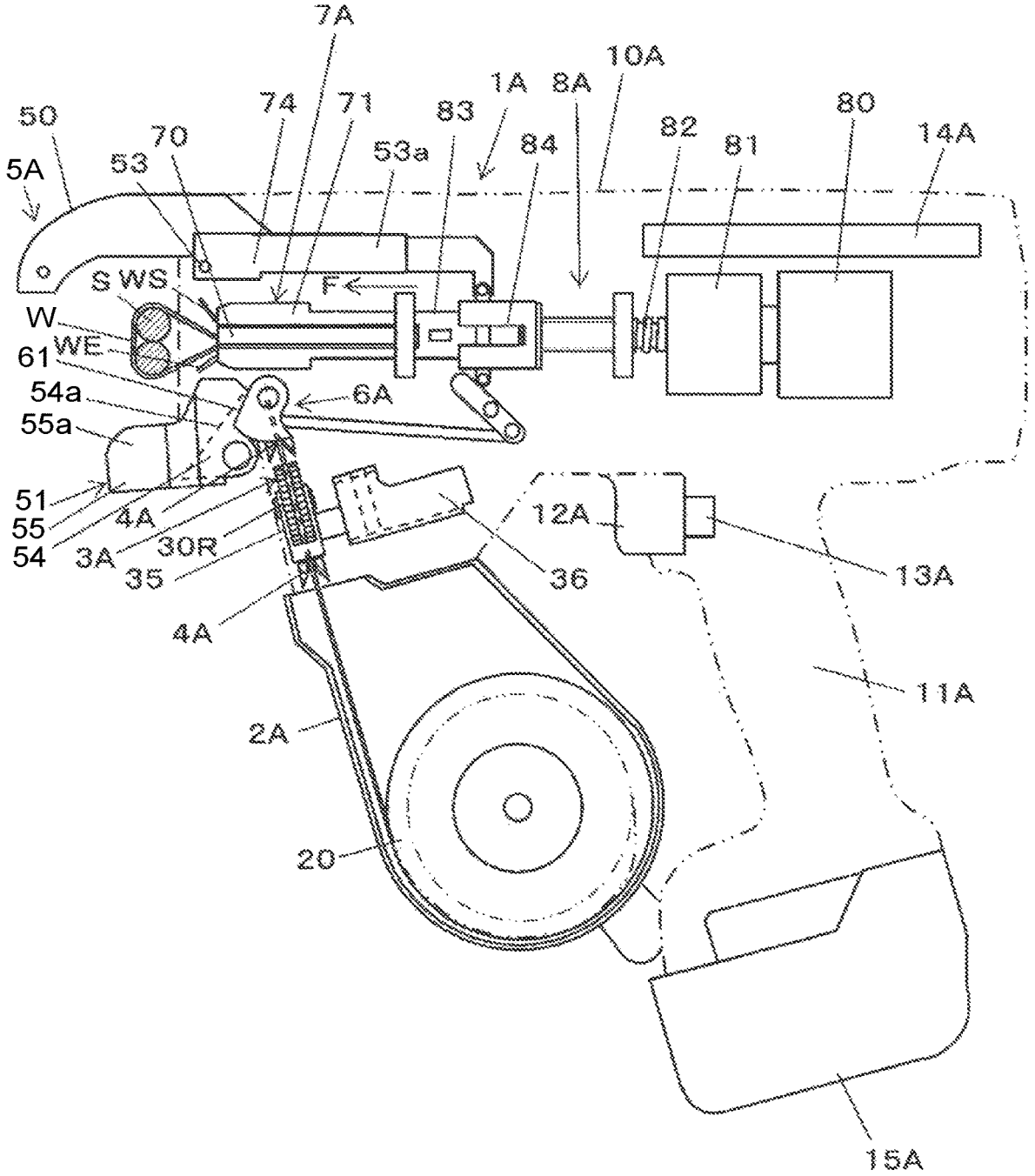
FIG. 12 is an explanatory view of an operation of the reinforcing bar binding machine of the present embodiment.

FIG. 12 illustrates a state in which the end of the wire W is bent toward the reinforcing bar S side. By moving the movable member 83 further in the forward direction after cutting the wire W, the bending portions 71*a*, 71*b* of the bending portion 71 moves in the forward direction integrally with the movable member 83.

As illustrated in FIGS. 16B and 16C, the bending portion 71*a* moves in a direction approaching the reinforcing bar S which is a forward direction indicated by an arrow F, so that the bending portion is brought into contact with one end WS side of the wire W gripped by the fixed gripping member 70C and the first movable gripping member 70L. Further, the bending portion 71*b* moves in the direction approaching the reinforcing bar S which is the forward direction indicated by the arrow F, so that the bending portion 71*b* is brought in contact with the other end WE side of the wire W gripped by the fixed gripping member 70C and the second movable gripping member 70R.

The bending portion 71*a* moves a predetermined distance in the forward direction indicated by the arrow F. Thereby the one end WS side of each wire W gripped by the fixed gripping member 70C and the first movable gripping member 70L is pressed to the reinforcing bar S side, and is bent toward the reinforcing bar S side using the fulcrum part 75 as the fulcrum.

As illustrated in FIGS. 16A and 16B, the fulcrum part 75 is provided for the gripping unit 70. The gripping unit 70 is provided with the anti-slip part 75, which protrudes in the direction of the fixed gripping member 70C, at the distal end of the first movable gripping member 70L. In this example, the anti-slip part 75 is configured to serve as the fulcrum part 75. Therefore, as the bending portion 71*a* moves in the forward direction indicated by the arrow F, the one end WS of each wire W gripped by the fixed gripping member 70C and the first movable gripping member 70L is bent to the reinforcing bar S side at the gripping position caused by the fixed gripping member 70C and the first movable gripping member 70L using the anti-slip part (the fulcrum part) 75 as the fulcrum. In FIG. 16B, the second movable gripping member 70R is not illustrated.

The bending portion 71*b* moves a predetermined distance in the forward direction indicated by the arrow F. Thereby the other end WE side of each wire W gripped by the fixed gripping member 70C and the second movable gripping member 70R is pressed to the reinforcing bar S side, and is bent toward the reinforcing bar S side using the fulcrum part 76 as the fulcrum.

As illustrated in FIGS. 16A and 16C, the fulcrum part 76 is provided for the gripping unit 70. The gripping unit 70 is provided with the anti-slip part 76, which protrudes in the direction of the fixed gripping member 70C, at the distal end of the second movable gripping member 70R. In this example, the anti-slip part 76 is configured to serve as the fulcrum part 76. Therefore, as the bending portion 71*b* moves in the forward direction indicated by the arrow F, the other end WE of each wire W gripped by the fixed gripping member 70C and the second movable gripping member 70R is bent to the reinforcing bar S side at the gripping position caused by the fixed gripping member 70C and the second movable gripping member 70R using the anti-slip part (the fulcrum part) 76 as the fulcrum. In FIG. 16C, the first movable gripping member 70L is not illustrated.

FIG. 13 illustrates a state in which the wire W is twisted. After the end of the wire W is bent toward the reinforcing bar S side, the motor 80 is further driven in the normal rotation direction, whereby the motor 80 further moves the movable member 83 in the direction of the arrow F which is the forward direction. When the movable member 83 moves to a predetermined position in the direction of the arrow F, the movable member 83 comes off from the locking of the rotation restricting member 84, and the regulation of rotation by the rotation restricting member 84 of the movable member 83 is released. As a result, the motor 80 is further driven in the normal rotation direction, whereby the gripping unit 70 gripping the wire W rotates and twists the wire W. The gripping unit 70 is biased backward by a spring (not illustrated), and twists the wire W while applying tension thereon. Therefore, the wire W is not loosened, and the reinforcing bar S is bound with the wire W.

FIG. 14 illustrates a state where the twisted wire W is released. After the wire W is twisted, the motor 80 is driven in the reverse rotation direction, so that the motor 80 moves the movable member 83 in the backward direction indicated by the arrow R. That is, in the movable member 83, the rotation operation interlocked with the rotation of the motor 80 is restricted by the rotation restricting member 84, and the rotation of the motor 80 is converted into a linear movement. As a result, the movable member 83 moves in the backward direction. In conjunction with the operation of the movable member 83 moving in the backward direction, the first movable gripping member 70L and the second movable gripping member 70R are displaced in a direction away from the fixed gripping member 70C, and the gripping unit 70 releases the wire W. When the binding of the reinforcing bar S is completed and the reinforcing bar S is pulled out from the reinforcing bar binding machine 1A, conventionally, the reinforcing bar S may be caught by the curl guide unit and it may be difficult to remove, which deteriorates workability in some cases. On the other hand, by configuring the movable guide unit 55 of the second guide unit 51 to be rotatable in the arrow H direction, when the reinforcing bar S is pulled out from the reinforcing bar binding machine 1A, the movable guide unit 55 of the second guide unit 51 does not catch the reinforcing bar S, and thus workability is improved.

Figure 17A:
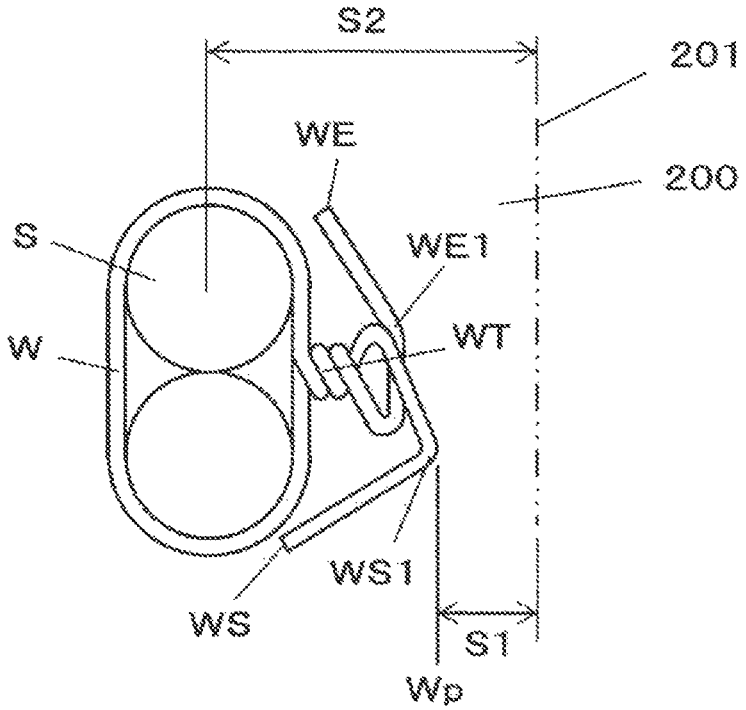
FIG. 17A is an example of operation and effects of the reinforcing bar binding machine of the present embodiment.
Figure 17B:
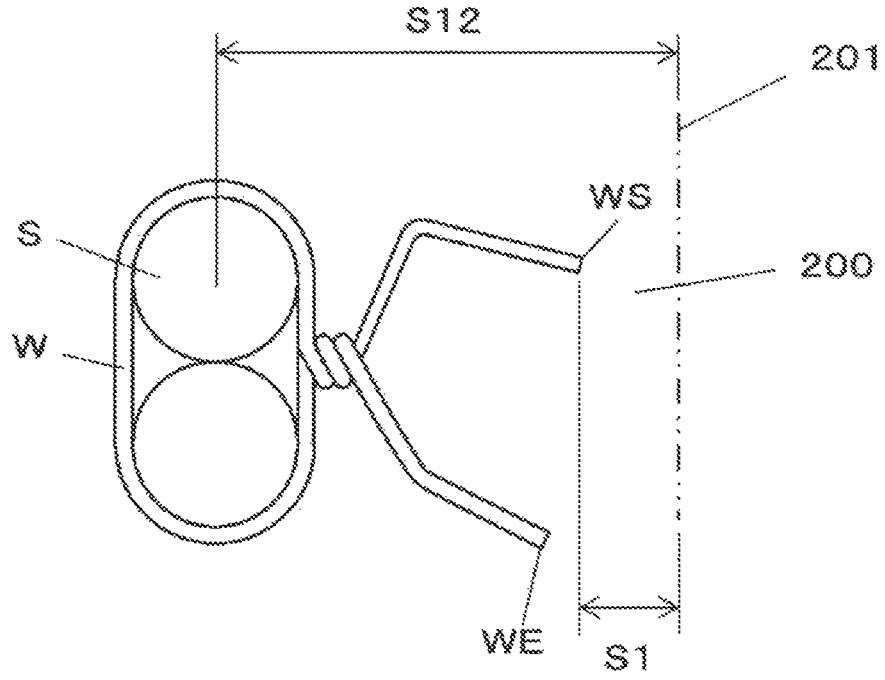
FIG. 17B is an example of operation and problems of a conventional reinforcing bar binding machine.

Operation and Effects of the Reinforcing Bar Binding Machine of the Embodiment FIG. 17A is an example of operation and effects of the reinforcing bar binding machine of the present embodiment, and FIG. 17B is an example of operation and problems of a conventional reinforcing bar binding machine Hereinafter, in regard to a form of the wire W binding the reinforcing bars S, an example of operation and effects of the reinforcing bar binding machine of the present embodiment will be described compared to the related art.

As illustrated in FIG. 17B, one end WS and the other end WE of the wire W are oriented in the opposite direction to the reinforcing bar S in the wire W bound to the reinforcing bar S in the conventional reinforcing bar binding machine. Therefore, one end WS and the other end WE of the wire W, which are the distal end side of the twisted portion of the wire W binding the reinforcing bar S largely protrude from the reinforcing bar S. If the distal end side of the wire W protrudes excessively, there is a possibility that the protruding portion interferes with the operation and hinders work.

Also, after the reinforcing bars S are bound, the concrete 200 is poured into the place where the reinforcing bars S are laid. At this time, in order to prevent the one end WS and the other end WE of the wire W from protruding from the concrete 200, the thickness from the tip of the wire W bound to the reinforcing bar S, in the example of FIG. 17B, the thickness from the one end WS of the wire W to the surface 201 of the concrete 200 that has been poured is necessarily kept at a predetermined dimension S1. Therefore, in a configuration in which the one end WS and the other end WE of the wire W face the direction opposite to the reinforcing bar S, the thickness S12 from the laying position of the reinforcing bar S to the surface 201 of the concrete 200 becomes thick.

On the other hand, in the reinforcing bar binding machine 1A of the present embodiment, the wire W is bent by the bending portion 71 such that one end WS of the wire W wound around the reinforcing bars S is located closer to the reinforcing bars S than a first bent region WS1 which is a bent region of the wire S and the other end WE of the wire W wound around the reinforcing bars S is located closer to the reinforcing bars S than a second bent region WE1 which is a bent region of the wire W. In the reinforcing bar binding machine 1A of the present embodiment, the wire W is bent by the bending portion 71 such that one of (i) a bent region bent by the preliminary bending portion 72 in the operation of gripping the wire W with the first movable gripping member 70L and the fixed gripping member 70C and (ii) a bent region bent by the fixed gripping member 70C and the second movable gripping member 70R in the operation of winding the wire W around the reinforcing bars S, becomes the top portion of the wire W. The top portion is the most protruding portion in a direction in which the wire W is separated from the reinforcing bars S. That is, in the present embodiment, at least one of the regions bent at the one end WS side and the other end WE side of the wire W binding the reinforcing bars S becomes the top.

As a result, as illustrated in FIG. 17A, the wire W bound to the reinforcing bar S in the reinforcing bar binding machine 1A according to the present embodiment has the first bent portion WS1 between the twisted portion WT and one end WS, and one end WS side of the wire W is bent toward the reinforcing bar S side so that one end WS of the wire W is located closer to the reinforcing bar S than the first bent portion WS1. The second bent portion WE1 is formed between the twisted portion WT and the other end WE of the wire W. The other end WE side of the wire W is bent toward the reinforcing bar S side so that the other end WE of the wire W is located closer to the reinforcing bar S side than the second bent portion WE1.

In the example illustrated in FIG. 17A, two bent portions, in this example, the first bent portion WS1 and the second bent portion WE1, are formed on the wire W. Of the two, in the wire W bound to the reinforcing bar S, the first bent portion WS1 protruding most in the direction away from the reinforcing bar S (the direction opposite to the reinforcing bar S) is the top portion Wp. Both of the one end WS and the other end WE of the wire W are bent so as not to protrude beyond the top portion Wp in the direction opposite to the reinforcing bar S.

In this manner, by setting one end WS and the other end WE of the wire W so as not to protrude beyond the top portion Wp constituted by the bent portion of the wire W in the direction opposite to the reinforcing bar S, it is possible to suppress a decrease in workability due to the protrusion of the end of the wire W. Since one end WS side of the wire W is bent toward the reinforcing bar S side and the other end WE side of the wire W is bent toward the reinforcing bar S side, the amount of protrusion on the distal end side from the twisted portion WT of the wire W is less than the conventional case. Therefore, the thickness S2 from the laying position of the reinforcing bar S to the surface 201 of the concrete 200 can be made thinner than the conventional one. Therefore, it is possible to reduce the amount of concrete to be used.

In the reinforcing bar binding machine 1A of the present embodiment, the wire W is wound around the reinforcing bar S by feeding in the forward direction, and one end WS side of the wire W wound and attached around the reinforcing bar S by feeding the wire Win the opposite direction is bent toward the reinforcing bar S side by the bending portion 71 in a state of being gripped by the fixed gripping member 70C and the first movable gripping member 70L. Further, the other end WE side of the wire W cut by the cutting unit 6A is bent toward the reinforcing bar S side by the bending portion 71 in a state of being gripped by the fixed gripping member 70C and the second movable gripping member 70R.

Thereby, the wire W can be bent using a gripping position caused by the fixed gripping member 70C and the first movable gripping member 70L as a fulcrum 71*c*1 as illustrated in FIG. 16B, and using a gripping position caused by the fixed gripping member 70C and the second movable gripping member 70R as a fulcrum 71*c*2 as illustrated in FIG. 16C. In addition, the bending portion 71 can apply a force for pressing the wire W in the direction of the reinforcing bars S by displacing the bending portions 71*a* and 71*b* in a direction in which the bending portions 71*a* and 71*b* approach the reinforcing bars S.

In this way, in the reinforcing bar binding machine 1A of the present embodiment, since the wire W is tightly gripped at the gripping position and is made to be bent by the bending portions 71*a* and 71*b* and the fulcrum parts 75 and 76 using the fulcrums 71*c*1 and 71*c*2 as fulcrums, the force for pressing the wire W is not dispersed in other directions, and the end WS side and the end WE side of the wire W can be reliably bent in a desired direction (to the reinforcing bar S side).

On the other hand, for example, in the conventional binding machine that applies a force in a direction in which the wire W is twisted in a state where the wire W is not gripped, the end of the wire W can be bent in a direction that twists the wire W, but a force to bend the wire W is applied in the state where the wire W is not gripped, so that the direction of bending the wire W is not fixed and the end of the wire W may face outward opposite to the reinforcing bar S in some cases.

However, in the present embodiment, as described above, since the wire W is tightly gripped at the gripping position and is made to be bent by the bending portions 71*a* and 71*b* and the fulcrum parts 75 and 76 using the fulcrums 71*c*1 and 71*c*2 as fulcrums, the end WS side and the end WE side of the wire W can be reliably directed to the reinforcing bar S side.

Further, if the end of the wire W is to be bent toward the reinforcing bar S side after twisting the wire W to bind the reinforcing bar S, there is a possibility that the binding place where the wire W is twisted is loosened and the binding strength decreases. Furthermore, when twisting the wire W to bind the reinforcing bar S and then trying to bend the wire end by applying a force in a direction in which the wire W is twisted further, there is a possibility that the binding place where the wire W is twisted is damaged.

On the other hand, in the present embodiment, since the wire is bent in the gripped state, the binding spot at which the wire W is twisted is not loosened, and the binding strength is not lowered. As a more preferred form, since the wire W is made to be bent before the wire W is twisted to bind the reinforcing bars S, and since no force is further applied in the direction in which the wire W is twisted after the wire W is twisted to bind the reinforcing bars S, the binding spot at which the wire W is twisted is not damaged.

Further, since the one end WS side and the other end WE side of the wire W are bent to the reinforcing bar S side before the wire W is twisted to bind the reinforcing bars S, the end portions of the wire W can be made to be previously directed to the reinforcing bar S side even when the operation of twisting the wire W is stopped halfway due to any malfunction or the like.

Figure 18A:
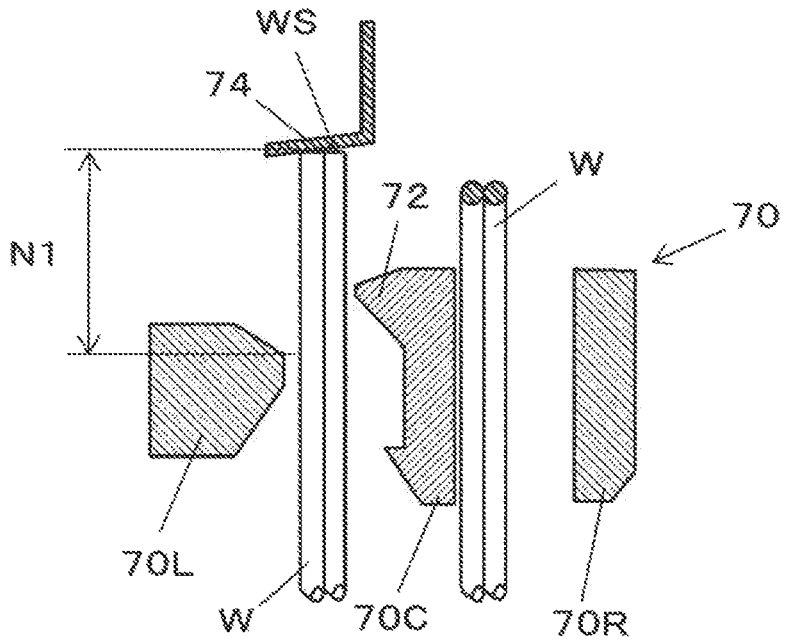
FIG. 18A is an example of operation and effects of the reinforcing bar binding machine of the present embodiment.
Figure 18B:
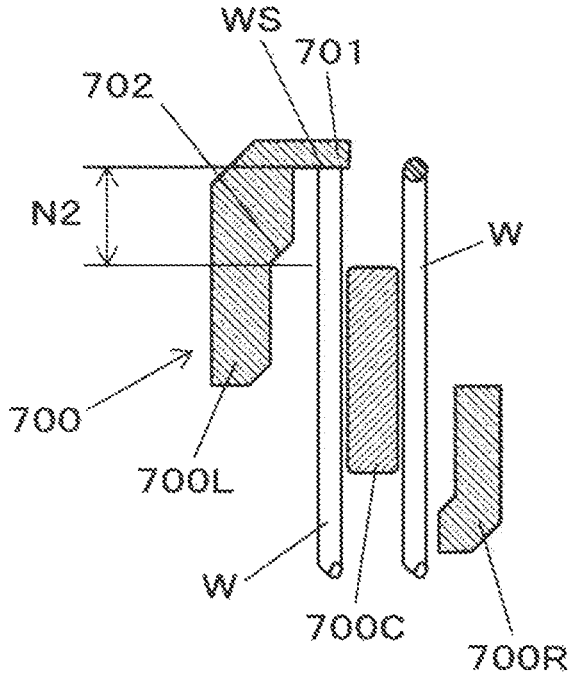
FIG. 18B is an example of operation and problems of the conventional reinforcing bar binding machine.
Figure 19A:
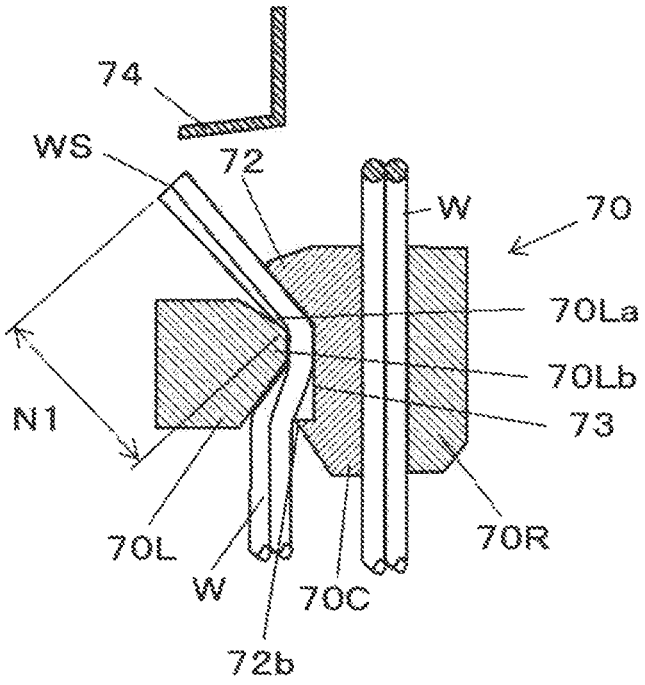
FIG. 19A is an example of operation and effects of the reinforcing bar binding machine of the present embodiment.
Figure 19B:
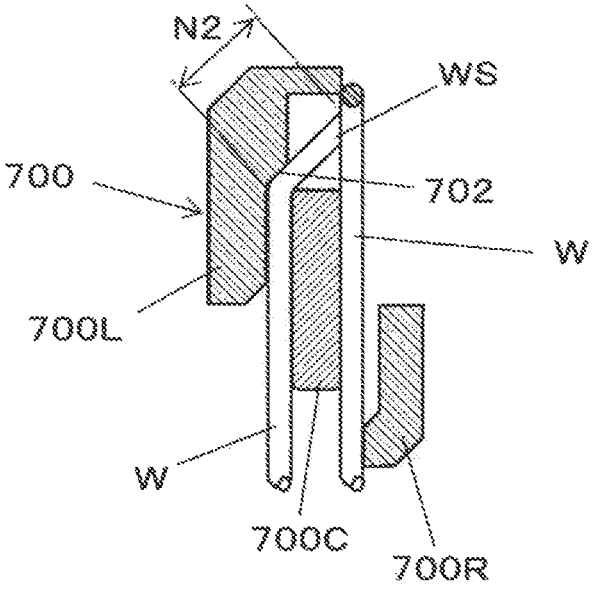
FIG. 19B is an example of operation and problems of the conventional reinforcing bar binding machine.

FIGS. 18A and 19A show examples of operational effects of the reinforcing bar binding machine according to the present embodiment, and FIGS. 18B and 19B show examples of the operations and problems of the conventional reinforcing bar binding machine. Hereinbelow, an example of the operational effect of the reinforcing bar binding machine according to the present embodiment as compared with the conventional one will be described in terms of prevention of the wire W coming out from the gripping unit in the operation of winding the wire W around the reinforcing bar S.

As illustrated in FIG. 18B, the conventional gripping unit 700 of the reinforcing bar binding machine includes a fixed gripping member 700C, a first movable gripping member 700L, and a second movable gripping member 700R, and a length restricting unit 701 against which the wire W wound around the reinforcing bar S abuts is provided in the first movable gripping member 700L.

In the operation of feeding the wire W in the backward direction (pulling back) and winding it around the reinforcing bar S and the operation of twisting the wire W by the gripping unit 700, the wire W gripped by the fixed gripping member 700C and the first movable gripping member 700L is likely to come off when the distance N2 from the gripping position of the wire W by the fixed gripping member 700C and the first movable gripping member 700L to the length restricting unit 701 is short.

In order to make it difficult for the gripped wire W to come off, it is simply necessary to lengthen the distance N2. However, for this purpose, it is necessary to lengthen the distance from the gripping position of the wire Win the first movable gripping member 700L to the length restricting unit 701.

However, if the distance from the gripping position of the wire Win the first movable gripping member 700L to the length restricting unit 701 is increased, the size of the first movable gripping member 700L is increased. Therefore, in the conventional configuration, it is not possible to lengthen the distance N2 from the gripping position of the wire W by the fixed gripping member 700C and the first movable gripping member 700L to one end WS of the wire W.

On the other hand, as illustrated in FIG. 18A, in the gripping unit 70 of the present embodiment, the length restricting unit 74 where the wire W abuts is set to be a separate component independent from the first movable gripping member 70L.

This makes it possible to lengthen the distance N1 from the gripping position of the wire W in the first movable gripping member 70L to the length restricting unit 74 without increasing the size of the first movable gripping member 70L.

Therefore, even if the first movable gripping member 70L is not enlarged, it is possible to prevent the wire W gripped by the fixed gripping member 70C and the first movable gripping member 70L from coming off during the operation of feeding the wire W in the backward direction to wind around the reinforcing bar S and the operation of twisting the wire W by the gripping unit 70.

As illustrated in FIG. 19B, the conventional gripping unit 700 of the reinforcing bar binding machine is provided with, on the surface of the first movable gripping member 700L facing the fixed gripping member 700C, a protrusion protruding toward the fixed gripping member 700C and a recess into which the fixed gripping member 700C is inserted, thereby forming a preliminary bending portion 702.

As a result, in the operation of gripping the wire W by the first movable gripping member 700L and the fixed gripping member 700C, one end WS side of the wire W protruding from the gripping position by the first movable gripping member 700L and the fixed gripping member 700C is bent, and in the operation of feeding the wire W in the backward direction to wind around the reinforcing bar S and the operation of twisting the wire W by the gripping unit 700, the effect of preventing the wire W from coming off can be obtained.

However, since one end WS side of the wire W is bent inward toward the wire W passing between the fixed gripping member 700C and the second movable gripping member 700R, the bent one end WS side of the wire W may be caught in contact with the wire W to be fed in the backward direction for winding around the reinforcing bar S.

When the bent one end WS side of the wire W is caught by the wire W that is fed in the backward direction for winding around the reinforcing bar S, there is a possibility that the winding of the wire W becomes insufficient or the twisting of the wire W is insufficient.

On the other hand, in the gripping unit 70 of the present embodiment, as illustrated in FIG. 19A, on the surface facing the first movable gripping member 70L of the fixed gripping member 70C, a protrusion protruding toward the first movable gripping member 70L and a recess into which the first movable gripping member 70L is inserted are provided to form the preliminary bending portion 72.

Thereby, in the operation of gripping the wire W with the first movable gripping member 70L and the fixed gripping member 70C, the one end WS side of the wire W protruding from the gripping position caused by the first movable gripping member 70L and the fixed gripping member 70C is bent. The one end WS side of the wire W is sandwiched by three points of the protrusion caused by the preliminary bending portion 72 in the fixed gripping member 70C, the protrusion caused by the first movable gripping member 70L entering the recess of the preliminary bending portion 72, and the other protrusion of the fixed gripping member 70C. Therefore, in the operation of feeding the wire W in the reverse direction to wind the wire W around the reinforcing bars S and the operation of twisting the wire W with the gripping unit 70, an effect of preventing the slip of the wire W is obtained.

One end WS side of the wire W is bent to the outside opposite to the wire W passing between the fixed gripping member 70C and the second movable gripping member 70R, so that it is suppressed that the bent one end WS side of the wire W is in contact with the wire W fed in the backward direction to wind around the reinforcing bar S.

Thus, in the operation of feeding the wire W in the backward direction to wind around the reinforcing bar S, it is prevented that the wire W comes off from the gripping unit 70, thereby surely winding the wire W, and in the operation of twisting the wire W, it is possible to reliably perform the binding of the wire W.

Figure 20A:
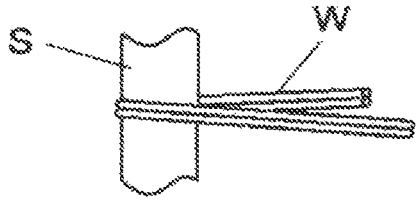
FIG. 20A is an example of operation and effects of the reinforcing bar binding machine of the present embodiment.
Figure 20B:
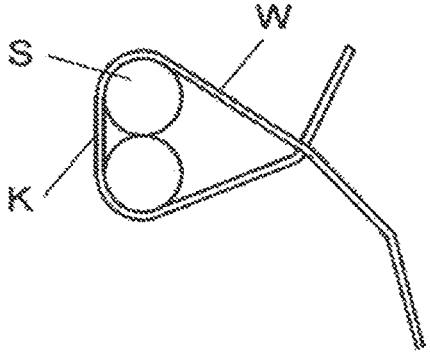
FIG. 20B is an example of operation and effects of the reinforcing bar binding machine of the present embodiment.
Figure 20C:
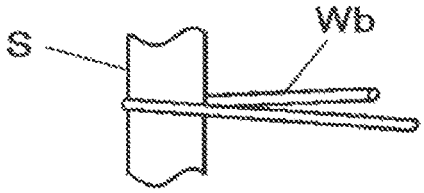
FIG. 20C is an example of operation and problems of the conventional reinforcing bar binding machine.
Figure 20D:
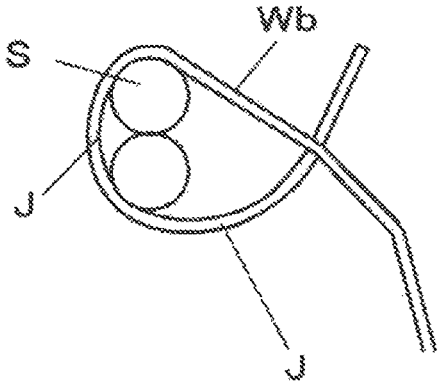
FIG. 20D is an example of operation and problems of the conventional reinforcing bar binding machine.
Figure 21A:
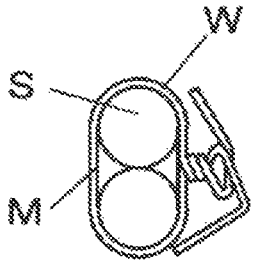
FIG. 21A is an example of operation and effects of the reinforcing bar binding machine of the present embodiment.
Figure 21B:
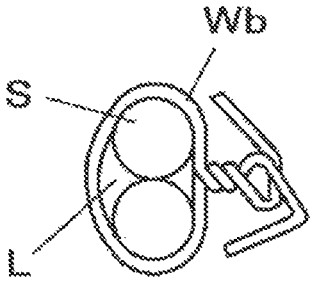
FIG. 21B is an example of operation and problems of the conventional reinforcing bar binding machine.

Example of Operational Effect of Reinforcing Bar Binding Machine of the Embodiment FIGS. 20A, 20B, and 21A show examples of operational effects of the reinforcing bar binding machine of the present embodiment, and FIGS. 20C, 20D, and 21B are examples of the operation and problems of the conventional reinforcing bar binding machine. Hereinbelow, an example of the operational effects of the reinforcing bar binding machine according to the present embodiment as compared with the related art will be described with respect to the operation of binding the reinforcing bar S with the wire W.

As illustrated in FIG. 20C, in the conventional configuration in which one wire Wb having a predetermined diameter (for example, about 1.6 mm to 2.5 mm) is wound around the reinforcing bar S, as illustrated in FIG. 20D, since the rigidity of the wire Wb is high, unless the wire Wb is wound around the reinforcing bar S with a sufficiently large force, slack J occurs during the operation of winding the wire Wb, and a gap is generated between the wire and the reinforcing bar S.

On the other hand, as illustrated in FIG. 20A, in the present embodiment in which two wires W having a small diameter (for example, about 0.5 mm to 1.5 mm) are wound around the reinforcing bar S as compared with the conventional case, as illustrated in FIG. 20B, since the rigidity of the wire W is lower than that of the conventional wire, even if the wire W is wound around the reinforcing bar S with a lower force than the conventional case, slack in the wire W occurring during the operation of winding the wire W is suppressed, and the wire is surely wound around the reinforcing bar S at the linear portion K. Considering the function of binding the reinforcing bar S with the wire W, the rigidity of the wire W varies not only by the diameter of the wire W but also by the material thereof etc. For example, in the present embodiment, the wire W having a diameter of about 0.5 mm to 1.5 mm is described as an example. However, if the material of the wire W is also taken into consideration, between the lower limit value and the upper limit value of the diameter of the wire W, at least a difference of about tolerance may occur.

Further, as illustrated in FIG. 21B, in the conventional configuration in which one wire Wb having a predetermined diameter is wound around the reinforcing bar S and twisted, since the rigidity of the wire Wb is high, even in the operation of twisting the wire Wb, the slack of the wire Wb is not eliminated, and a gap L is generated between the wire and the reinforcing bar S.

On the other hand, as illustrated in FIG. 21A, in the present embodiment in which two wires W having a smaller diameter are wound around the reinforcing bar S and twisted as compared with the related art, the rigidity of the wire W is lower as compared with the conventional one, by the operation of twisting the wire W, the gap M between the reinforcing bar S and the wire can be suppressed small as compared with the conventional case, whereby the binding strength of the wire W is improved.

By using the two wires W, it is possible to equalize the reinforcing bar holding force as compared with the conventional case, and to suppress the deviation between the reinforcing bars S after the binding. In the present embodiment, two wires W are simultaneously fed, and the reinforcing bars S are bound using the two wires W fed simultaneously. Feeding the two wires W at the same time means that when one wire W and the other wire W are fed at substantially the same speed, that is, when the relative speed of the other wire W to one wire W is substantially 0. In this example, the meaning is not necessarily limited to this meaning. For example, even when one wire W and the other wire W are fed at different speeds (timings), the two wires W are advance in parallel in the feed path of the wire W in a state that the two wires W are arranged in parallel with each other, so, as long as the wire W is set to be wound around the reinforcing bar S in the parallel state, it means that two wires are fed at the same time. In other words, the total area of the cross-sectional area of each of the two wires W is a factor determining the reinforcing bar holding force, so even if the timings of feeding the two wires W are deviated, in terms of securing the reinforcing bar holding force, the same result can be obtained. However, compared to the operation of shifting the timing of feeding the two wires W, since it is possible to shorten the time required for feeding for the operation of simultaneously feeding the two wires W, it is preferable to feed the two wires W simultaneously, resulting in improvement of the binding speed.

Modification of the Reinforcing Bar Binding Machine of the Embodiment

In the reinforcing bar binding machine 1A of the present embodiment, the configuration in which the two wires are used has been described by way of example. However, the reinforcing bars S may be bound with one wire, or the reinforcing bars S may be bound with two or more wires. In addition, the reinforcing bar binding machine 1A of the present embodiment is configured such that the length restricting unit 74 is provided for the first guide unit 50 of the curl guide unit 5A, but it may be provided at another place as long as it is a component, such as the first movable gripping member 70L, independent of the gripping unit 70. For example, the length restricting unit 74 may be provided for a structure that supports the gripping unit 70.

Further, the reinforcing bar binding machine 1A of the present embodiment is configured such that the wire W is twisted by the rotating operation of the gripping unit 70 after the one end WS side and the other end WE side of the wire W is bent to the reinforcing bar S side by the bending portion 71. However, before the operation of bending the wire W is completed, the operation of twisting the wire W may be initiated After the operation of twisting the wire W is initiated by onset of the rotating operation of the gripping unit 70, the wire W may be made to be bent before the operation of twisting the wire W is completed. Further, the operation of twisting the wire W is completed, the wire W may be made to be bent (while maintaining the state in which the wire W is gripped).

In addition, the bending portion has the configuration in which the bending portion 71 is integrated with the movable member 83, but it may have a configuration in which the bending portion 71 is independent of the movable member 83. The gripping unit 70 and the bending portion 71 may be configured to be driven by an independent driving unit such as a motor. Further, instead of the bending portion 71, the bending portion may be provided with the fixed gripping member 70C and the bending portion that is formed in a concavo-convex shape or the like and applies the force, which bends the wire W to the reinforcing bar S side in the operation of gripping the wire W, to the first movable gripping member 70L and the second movable gripping member 70R.

Figure 22A:
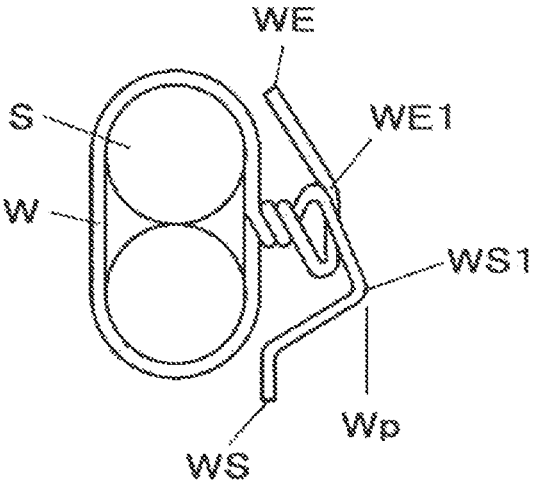
FIG. 22A is an explanatory view illustrating a modification of the present embodiment.
Figure 22B:
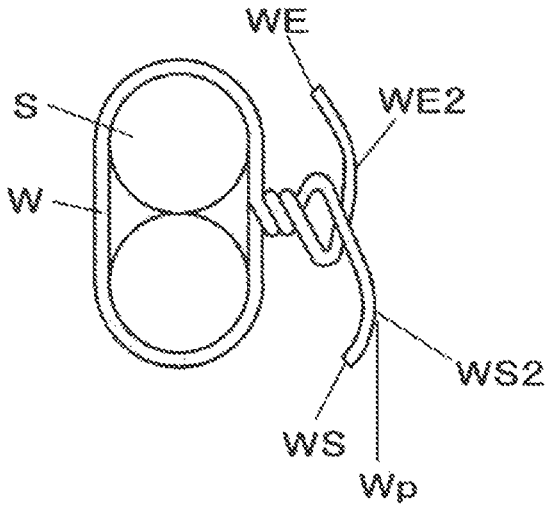
FIG. 22B is an explanatory view illustrating a modification of the present embodiment.
Figure 22C:
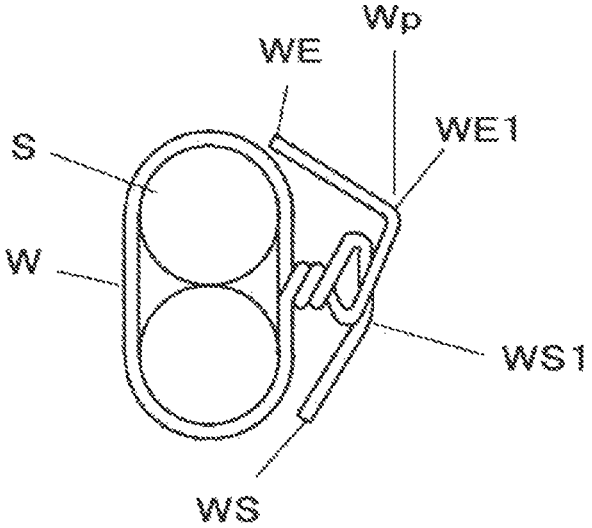
FIG. 22C is an explanatory view illustrating a modification of the present embodiment.

FIGS. 22A, 22B and 22C are explanatory views illustrating a modification of the present embodiment. In the reinforcing bar binding machine 1A of the present embodiment, the bending portion 71 places the one end WS of the wire W at the reinforcing bar S side beyond the first bent region WS1 of the wire W, and places the other end WE of the wire W, which is wound around the reinforcing bars S, at the reinforcing bar S side beyond the second bent region WE1 of the wire W. In the example illustrated in FIG. 22A, since the first bent region WS1 that is the region protruding fully in the direction opposite to the reinforcing bars S becomes the top Wp, it will do if the one end WS and the other end WE of the wire W are prevented from exceeding the top Wp formed on the first bent region WS1 to protrude in the direction opposite to the reinforcing bars S. For this reason, as illustrated in FIG. 22A, for example, if the one end WS side of the wire W is bent to the reinforcing bar S side on the first bent region WS1, the one end WS of the wire W need not face the reinforcing bar S side, e.g., as shown at the tip or free end WS.

As illustrated in FIG. 22B, a bending portion for bending the first bent region WS2 and the second bent region WE2 to have a curved shape may be provided. In this case, a region that fully protrudes in a direction opposite to the reinforcing bars S becomes a first bent region WS2, and hence the first bent region WS2 becomes the top Wp, and one end WS and the other end WE of the wire W are prevented from exceeding the top Wp formed on the first bent region WS2 to protrude in the direction opposite to the reinforcing bars S.

Further, as illustrated in FIG. 22C, one end WS side of the wire W is bent to the reinforcing bar S side such that one end WS of the wire W is located closer to the reinforcing bars S than a first bent region WS1. In addition, the other end WE side of the wire W is bent to the reinforcing bar S side such that the other end WE of the wire W is located closer to the reinforcing bars S than a second bent region WE1. In the wire W binding the reinforcing bars S, a second bent region WE1 that fully protrudes in a direction opposite to the reinforcing bars S may be made to become the top Wp. Any of the one end WS and the other end WE of the wire W is bent such that it is prevented from exceeding the top Wp to protrude in the direction opposite to the reinforcing bars S.

Modified Example of Reinforcing Bar Binding Machine in the Embodiment

FIGS. 23A, 23B, 23C, 23D, and 23E are diagrams illustrating modified examples of the parallel guide of the present embodiment. As a configuration to bind the reinforce bar S by two or more wires W, in the parallel guide 4B illustrated in FIG. 23A, the cross-sectional shape of the opening 4BW, that is, the cross-sectional shape of the opening 4BW in a direction orthogonal to the feeding direction of the wire W is formed in a rectangular shape, and the longitudinal direction (L1) and the lateral direction (L2) of the opening 4BW are formed in a straight shape. In the parallel guide 4B, the length L1 in the longitudinal direction of the opening 4BW is slightly twice or more times longer than the diameter r of the wire W in a form in which the wires W are arranged in parallel along the radial direction, and the length L2 in the lateral direction is slightly longer than the diameter r of one wire W. In the parallel guide 4B in this example, the length L1 of the opening 4BW in the longitudinal direction is slightly twice longer than the diameter r of the wire W.

Figure 23A:
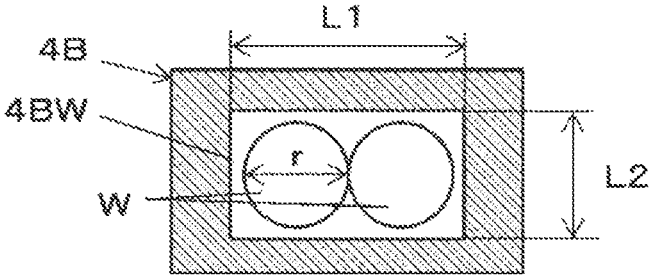
FIG. 23A is a view illustrating a modification of the parallel guide of the present embodiment.
Figure 23B:
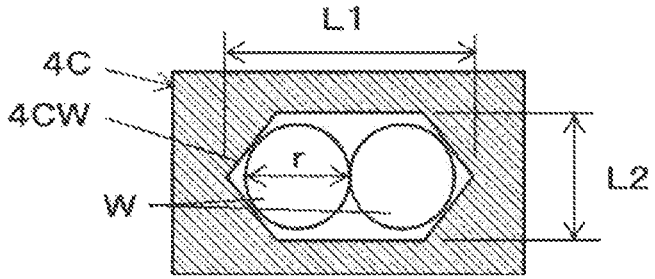
FIG. 23B is a view illustrating a modification of the parallel guide of the present embodiment.

In the parallel guide 4C illustrated in FIG. 23B, the longitudinal direction of the opening 4CW is formed in a straight shape and the lateral direction is formed in a triangular shape. In the parallel guide 4C, in order that a plurality of wires W are arranged in parallel in the longitudinal direction of the opening 4CW and the wire W can be guided by an inclined plane in the lateral direction, the longitudinal length L1 of the opening 4CW is slightly twice or more times longer than the diameter r of the wire W in the form in which the wires W are arranged along the radial direction, and the lateral length L2 is slightly longer than the diameter r of one wire W.

Figure 23C:
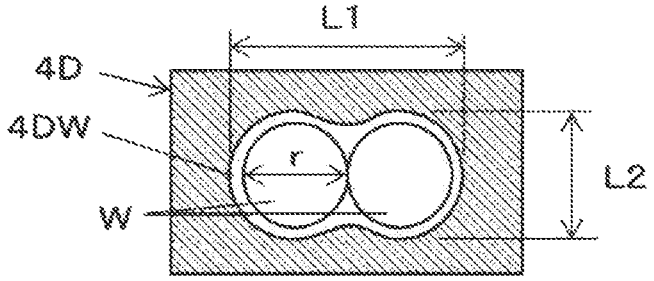
FIG. 23C is a view illustrating a modification of the parallel guide of the present embodiment.

In the parallel guide 4D illustrated in FIG. 23C, the longitudinal direction of the opening 4DW is formed in a curved shape which is curved inward in a convex shape and the lateral direction is formed in a circular arc shape. That is, the opening shape of the opening 4DW is formed in a shape that conforms to the outer shape of the parallel wires W. In the parallel guide 4D, the length L1 in the longitudinal direction of the opening 4DW is slightly twice or more times longer than the diameter r of the wire W in the form in which the wires W are arranged along the radial direction, the length L2 in the lateral direction is slightly longer than the diameter r of one wire W. In the parallel guide 4D, in the present example, the length L1 in the longitudinal direction has a length slightly twice longer than the diameter r of the wire W.

Figure 23D:
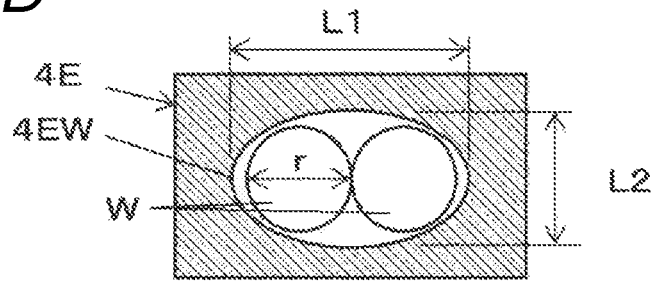
FIG. 23D is a view illustrating a modification of the parallel guide of the present embodiment.

In the parallel guide 4E illustrated in FIG. 23D, the longitudinal direction of the opening 4EW is formed in a curved shape curved outward in a convex shape, and the lateral direction is formed in a circular arc shape. That is, the opening shape of the opening 4EW is formed in an elliptical shape. The parallel guide 4E has a length L1 in the longitudinal direction of the opening 4EW which is slightly twice or more times longer than the diameter r of the wire W in the form in which the wires W are arranged along the radial direction, and a length L2 in the lateral direction is slightly longer than the diameter r of one wire W. In this example, the parallel guide 4E has a length L1 in the longitudinal direction slightly twice longer than the diameter r of the wire W.

Figure 23E:
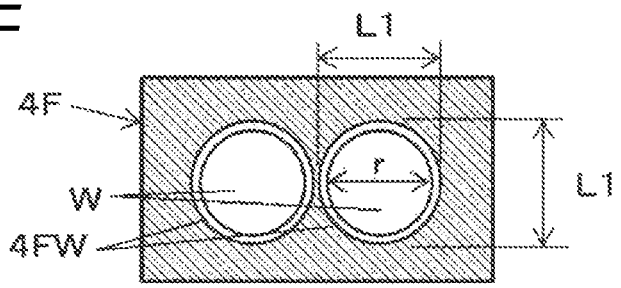
FIG. 23E is a view illustrating a modification of the parallel guide of the present embodiment.

The parallel guide 4F illustrated in FIG. 23E includes a plurality of openings 4FW matching the number of wires W. Each wire W is passed through another opening 4FW one by one. In the parallel guide 4F, each opening 4FW has a diameter (length) L1 slightly longer than the diameter r of the wire W, and by the direction in which the openings 4FW are arranged, relative movement between the two wires in directions orthogonal to the feed direction is restricted or limited, and the plurality of wires W are arranged in parallel.

Figure 24:
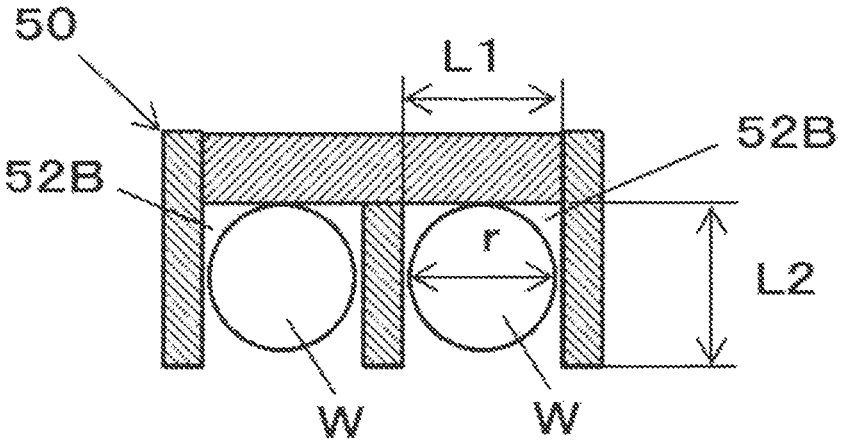
FIG. 24 is a view illustrating a modification of the guide groove of the present embodiment.

FIG. 24 is a diagram illustrating a modified example of the guide groove of this embodiment. The guide groove 52B has a width (length) L1 and a depth L2 slightly longer than the diameter r of the wire W. Between one guide groove 52B through which one wire W passes and the other guide groove 52B through which the other wire W passes, a section wall portion is formed along the feeding direction of the wire W. The first guide unit 50 restricts the direction of movement a relative movement so that the plurality of wires are arranged in parallel with each other by the direction in which the plurality of guide grooves 52B are arranged.

Figure 25A:
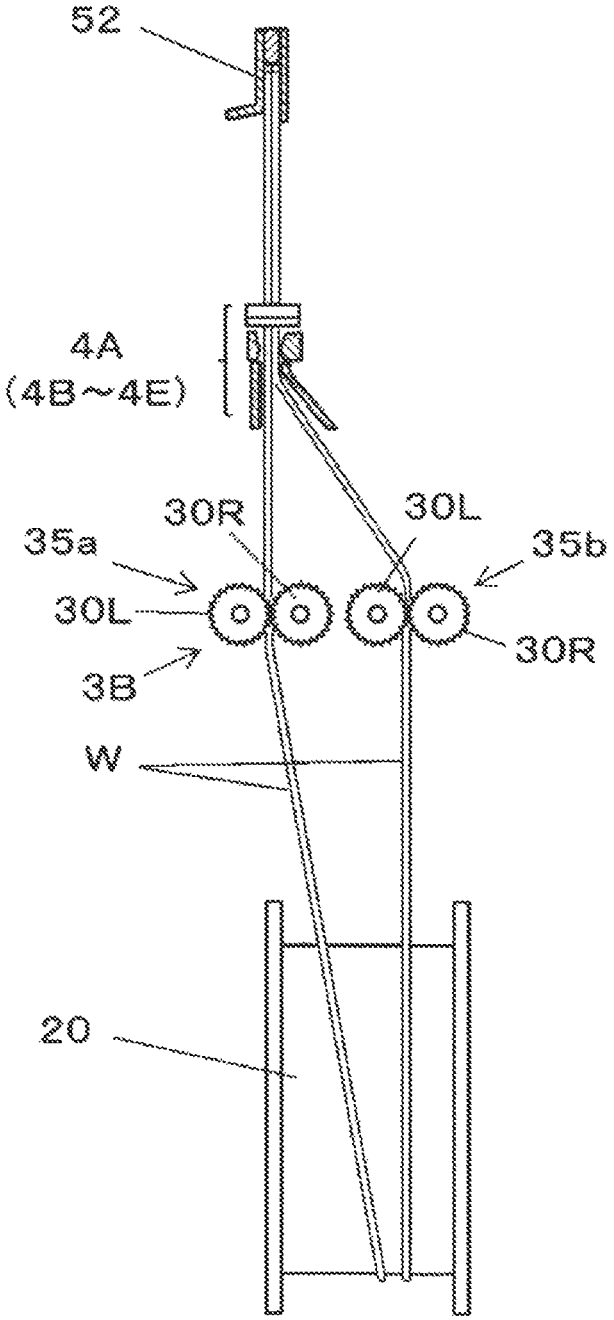
FIG. 25A is a view illustrating a modification of a wire feeding unit according to the present embodiment.
Figure 25B:
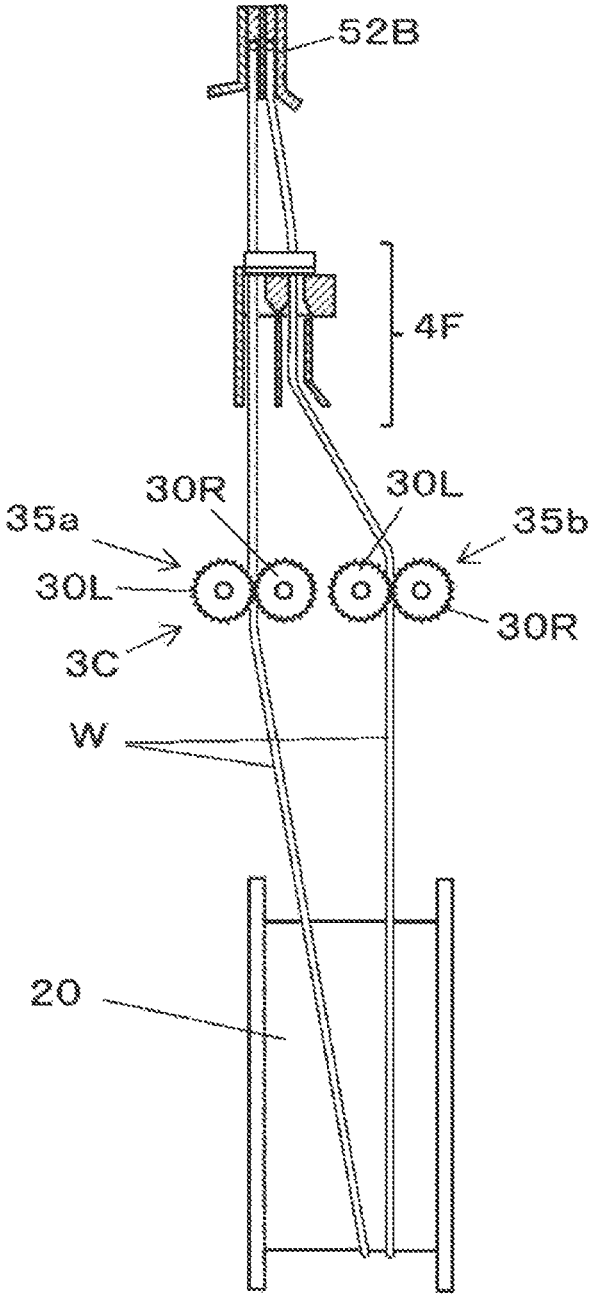
FIG. 25B is a view illustrating a modification of the wire feeding unit according to the present embodiment.

FIGS. 25A and 25B are diagrams illustrating modified examples of the wire feeding unit according to the present embodiment. The wire feeding unit 3B illustrated in FIG. 25A includes a first wire feeding unit 35*a* and a second wire feeding unit 35*b* that feed the wires W one by one. The first wire feeding unit 35*a* and the second wire feeding unit 35*b* are provided with a first feed gear 30L and a second feed gear 30R, respectively.

Each wire W fed one by one by the first wire feeding unit 35*a* and the second wire feeding unit 35*b* is arranged in parallel in a predetermined direction by the parallel guide 4A illustrated in FIG. 4A, 4B, or 4C, or the parallel guides 4B to 4E illustrated in FIG. 23A, 23B, 23C, or 23D, and the guide groove 52 illustrated in FIG. 5.

The wire feeding unit 3C illustrated in FIG. 25B includes a first wire feeding unit 35*a* and a second wire feeding unit 35*b* that feed the wires W one by one. The first wire feeding unit 35*a* and the second wire feeding unit 35*b* are provided with a first feed gear 30L and a second feed gear 30R, respectively.

Each of the wires W fed one by one by the first wire feeding unit 35*a* and the second wire feeding unit 35*b* is arranged in parallel in a predetermined direction by the parallel guide 4F illustrated in FIG. 23E and the guide groove 52B illustrated in FIG. 24B. In the wire feeding unit 30C, since the two wires W are independently guided, if the first wire feeding unit 35*a* and the second wire feeding unit 35*b* can be independently driven, it is also possible to shift the timing to feed the two wires W. Even if the operation of winding the reinforcing bar S is performed by starting the feeding of the other wire W from the middle of the operation of winding the reinforcing bar S with one of the two wires W, the two wires W are regarded to be fed at the same time. Also, although feeding of two wires W is started at the same time, when the feeding speed of one wire W is different from the feeding speed of the other wire W, the two wires W are regarded to be simultaneously fed as well.

FIGS. 26 to 31 are explanatory views illustrating a configuration and an operation of a gripping unit of another embodiment. Another embodiment of a direction in which one end WS of the wire W is bent will be described.

The wire W formed in a circular arc shape by the first guide unit 50 of the curl guide unit 5A is curled such that positions of two points outside the circular arc and one point inside the circular arc are restricted at three points of the fixed blade portion 60 constituting the parallel guide 4A at the cutting discharge position P3 and the guide pins 53 and 53*b* of the first guide unit 50, thereby forming a substantially circular loop Ru.

In the operation of feeding the wire W in the reverse direction with the wire feeding unit 3A to wind the wire W around the reinforcing bars S, the wire W moves in a direction in which a diameter of the loop Ru is reduced.

In the above-mentioned embodiment, as illustrated in FIG. 19A, the end WS of the wire W is configured to be bent to the outside opposite to the wire W passing between the fixed gripping member 70C and the second movable gripping member 70R by the preliminary bending portion 72. Thereby, the end WS of the wire W is retreated from the moving path of the wire W based on the operation of winding the wire W around the reinforcing bars S. In the form illustrated in FIGS. 26 and 27, when bent to the outside opposite to the wire W passing between the fixed gripping member 70C and the second movable gripping member 70R, the end WS of the wire W is bent toward the inside in the radial direction of the loop Ru formed by the wire W. In the form illustrated in FIGS. 28 and 29, when bent to the outside opposite to the wire W passing between the fixed gripping member 70C and the second movable gripping member 70R, the end WS of the wire W is bent toward the outside in the radial direction of the loop Ru formed by the wire W. For this reason, the gripping unit 70 is provided with the preliminary bending portion 72*a* that is wound around the reinforcing bars S and bends the wire W from the moving path Ru3 of the wire W, along which the wire W moves in the direction in which the diameter of the loop Ru of the wire W is reduced, in the predetermined direction in which the end WS of the wire W is retreated.

Figure 26:
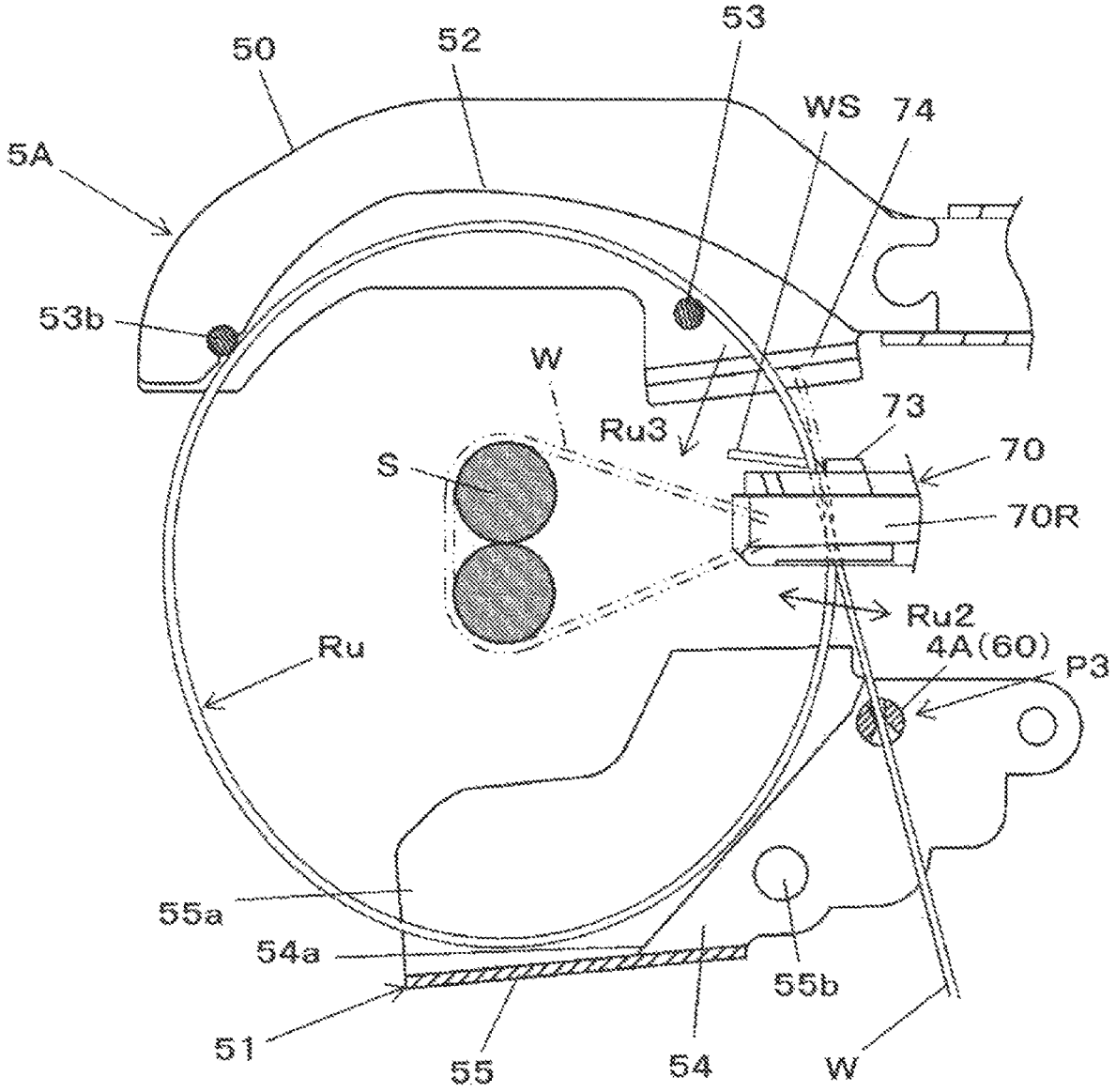
FIG. 26 is an explanatory view illustrating a configuration and an operation of the gripping unit of another embodiment.
Figure 27:
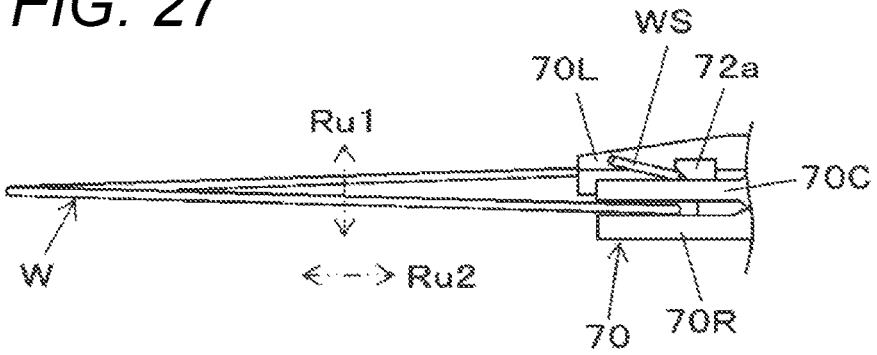
FIG. 27 is an explanatory view illustrating a configuration and an operation of the gripping unit of another embodiment.

In FIGS. 26 and 27, the preliminary bending portion 72*a* is provided on the surface facing the first movable gripping member 70L of the fixed gripping member 70C, and protrudes in the direction in which the wire W is bent toward the inside in the radial direction of the loop Ru formed by the wire W and in the direction Ru2 running in the direction orthogonal to the feeding direction of the wire W of the parallel guide 4A.

Thereby, in the operation of gripping the wire W with the first movable gripping member 70L and the fixed gripping member 7C, the end WS of the wire W is bent toward the inside in the radial direction of the loop Ru formed by the wire W and in the direction Ru2 running in the direction orthogonal to the feeding direction of the wire W of the parallel guide 4A. The end WS of the wire W is bent toward the outside opposite to the wire W passing between the fixed gripping member 70C and the second movable gripping member 70R in the axial direction Ru1 of the loop Ru formed by the wire W, as illustrated in FIG. 19A.

Therefore, in the operation of winding the wire W around the reinforcing bars S, the end WS of the wire W passing between the first movable gripping member 70L and the fixed gripping member 70C does not interfere with the wire W passing between the fixed gripping member 70C and the second movable gripping member 70R, and thereby the end WS of the wire W is inhibited from being rolled into the wire W.

Figure 28:
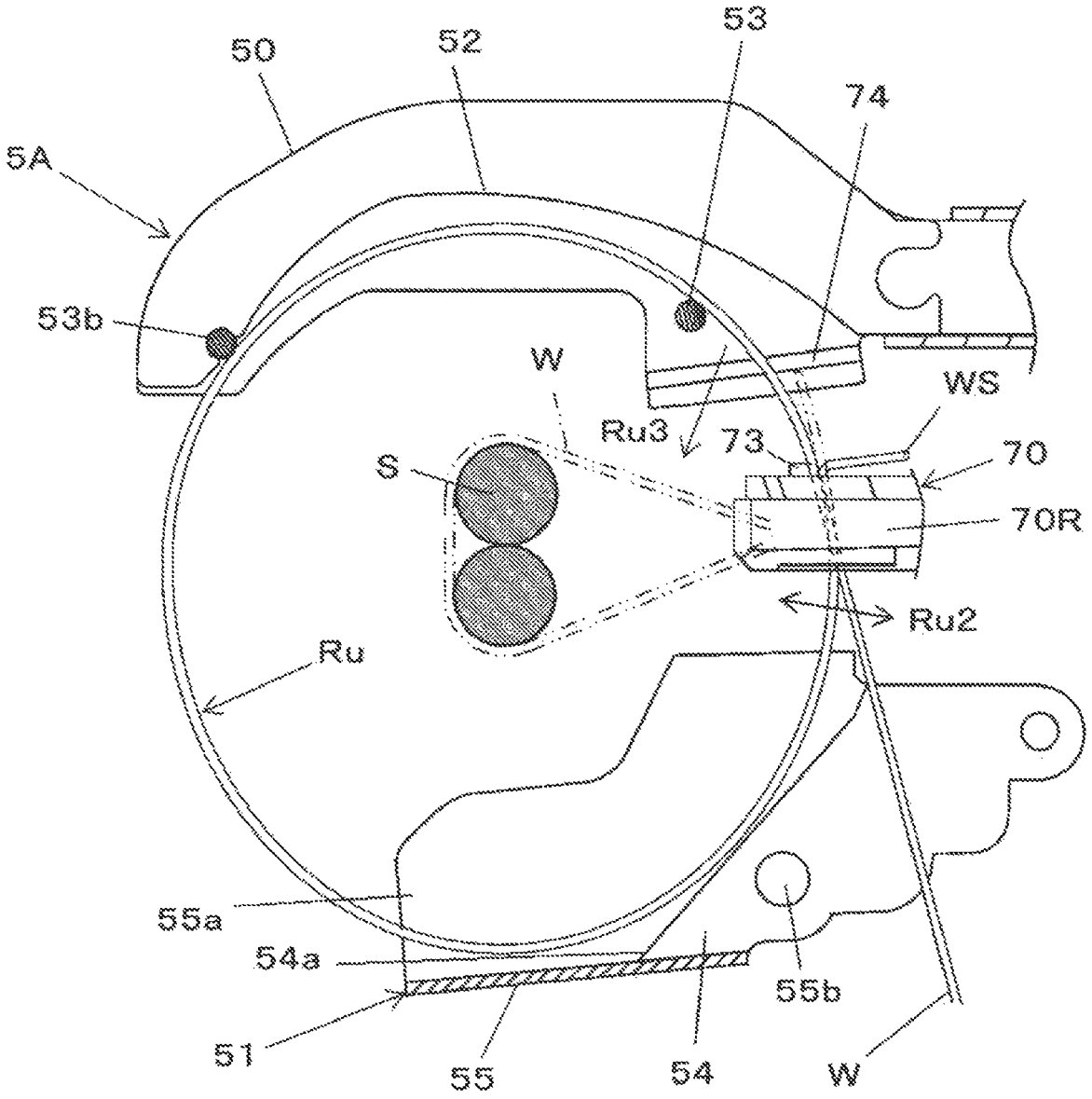
FIG. 28 is an explanatory view illustrating a configuration and an operation of the gripping unit of another embodiment.
Figure 29:
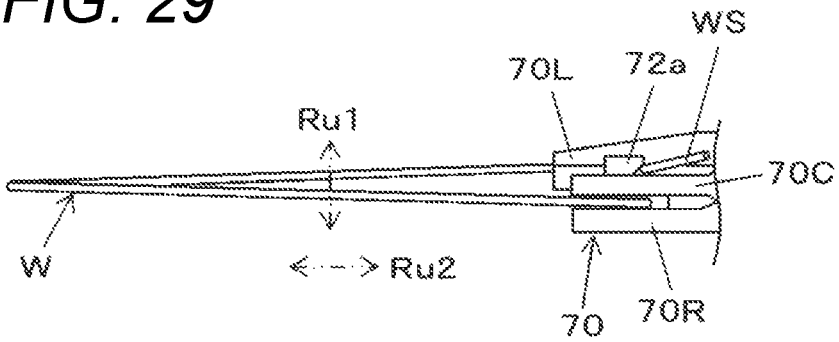
FIG. 29 is an explanatory view illustrating a configuration and an operation of the gripping unit of another embodiment.

In FIGS. 28 and 29, the preliminary bending portion 72*a* is provided on the surface facing the first movable gripping member 70L of the fixed gripping member 70C, and protrudes in the direction in which the wire W is bent toward the outside in the radial direction of the loop Ru formed by the wire W and in the direction Ru2 running in the direction orthogonal to the feeding direction of the wire W of the parallel guide 4A.

Thereby, in the operation of gripping the wire W with the first movable gripping member 70L and the fixed gripping member 7C, the end WS of the wire W is bent toward the outside in the radial direction of the loop Ru formed by the wire W and in the direction Ru2 running in the direction orthogonal to the feeding direction of the wire W of the parallel guide 4A. The end WS of the wire W is bent toward the outside opposite to the wire W passing between the fixed gripping member 70C and the second movable gripping member 70R in the axial direction Ru1 of the loop Ru formed by the wire W, as illustrated in FIG. 19A.

Therefore, in the operation of winding the wire W around the reinforcing bars S, the end WS of the wire W passing between the first movable gripping member 70L and the fixed gripping member 70C does not interfere with the wire W passing between the fixed gripping member 70C and the second movable gripping member 70R, and thereby the end WS of the wire W is inhibited from being rolled into the wire W.

Figure 30:
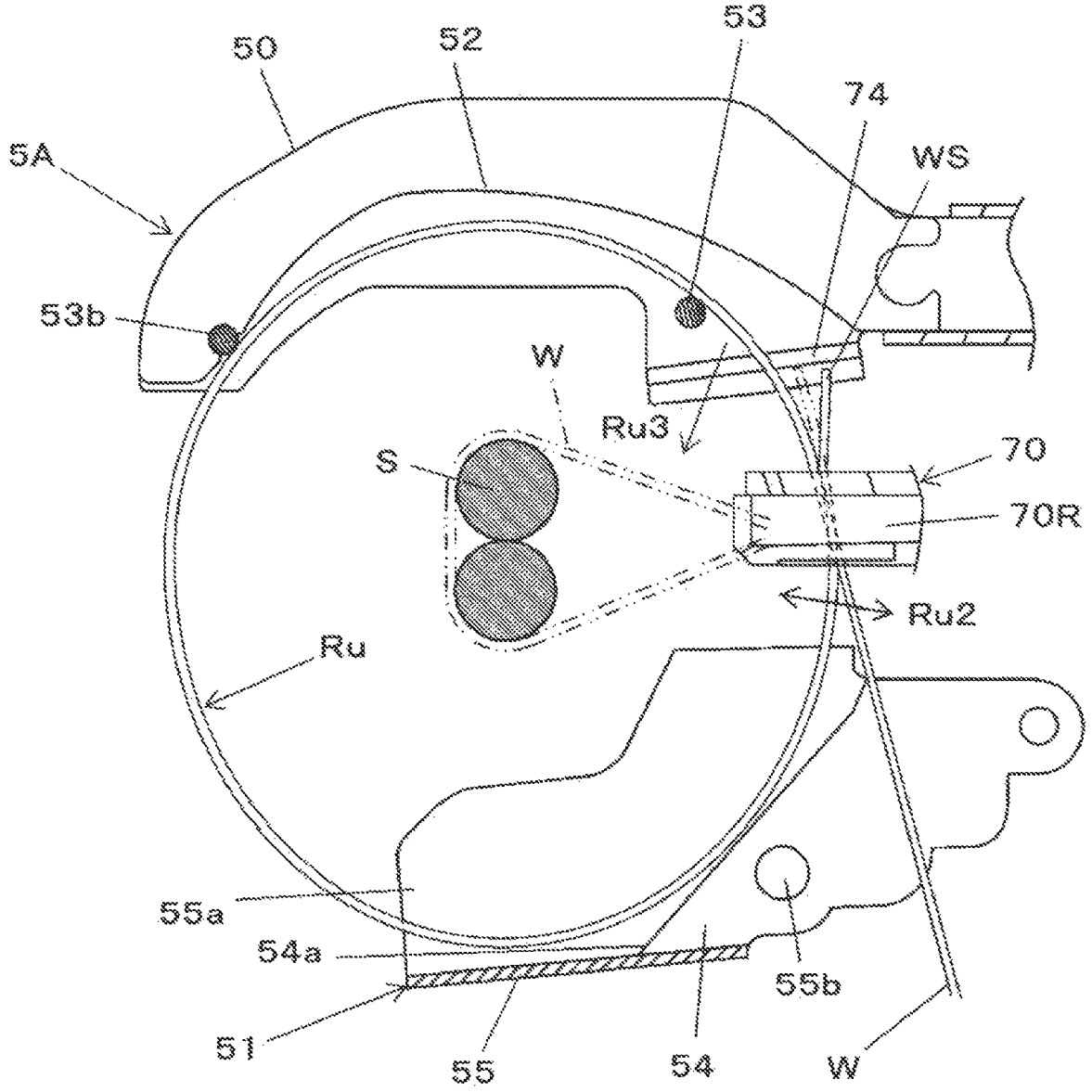
FIG. 30 is an explanatory view illustrating a configuration and an operation of the gripping unit of another embodiment.
Figure 31:
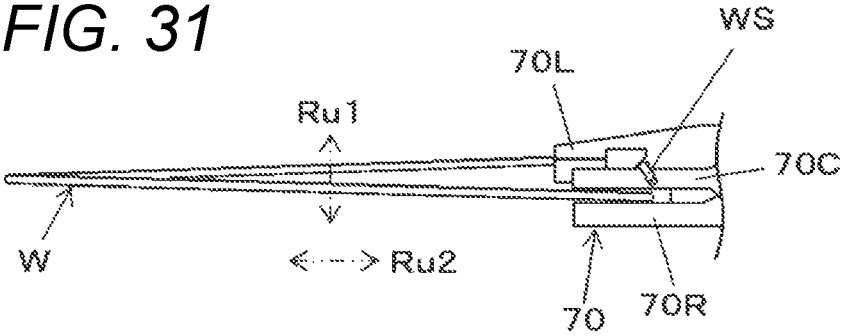
FIG. 31 is an explanatory view illustrating a configuration and an operation of the gripping unit of another embodiment.

With respect to the embodiment described in FIGS. 26 to 29, if the end WS of the wire W can be retreated from the moving path of the wire W based on the operation of winding the wire W around the reinforcing bars S, the end WS of the wire W may be bent toward the wire W passing between the fixed gripping member 70C and the second movable gripping member 70R. In FIGS. 30 and 31, the length restricting unit 74, which restricts the position of the one end WS of the wire W provided in the first guide unit 50 of the curl guide unit 5A, is formed to guide the end WS of the wire W to the outside in the radial direction of the loop Ru formed by the wire W and in the direction Ru2 running in the direction orthogonal to the feeding direction of the wire W of the parallel guide 4A.

Thereby, in the operation of feeding the wire W to butt the end WS of the wire W against the length restricting unit 74, the end WS of the wire W is bent toward the outside in the radial direction of the loop Ru formed by the wire W and in the direction Ru2 running in the direction orthogonal to the feeding direction of the wire W of the parallel guide 4A.

Therefore, due to the form in which the end WS of the wire W passing between the first movable gripping member 70L and the fixed gripping member 70C is bent toward the wire W passing between the fixed gripping member 70C and the second movable gripping member 70R in the axial direction Ru1 of the loop Ru formed by the wire W without interference, the end WS of the wire W is inhibited from being rolled into the wire W in the operation of winding the wire W around the reinforcing bars S.

In place of the configuration in which the plurality of wires are fed at the same time, the other modification of the present embodiment may be configured to feed and wind one wire W around the reinforcing bars S at a time, wind the plurality of wires, and then feed the plurality of wires in the reverse direction to wind the wires around the reinforcing bars S.

A magazine for housing short wires W may be provided, and a plurality of wires W may be supplied at a time.

Further, the wire may be supplied from an external independent wire supply portion without providing the magazine in the main body portion.

The present invention can also be applied to a binding machine for binding pipes or the like as binding objects with a wire(s).

In the present embodiment, the portable reinforcing bar binding machine 1A that can be carried has been described by way of example, but the present invention is not limited thereto. For example, the reinforcing bar binding machine 1A may be a fixed binding machine.

Some or all of the above embodiments can be described as follows.

(Additional Note 1)

A binding machine comprising:

a housing (a magazine) that is capable of drawing out a wire;

a wire feeding unit that feeds the wire drawn out of the housing;

a curl guide that curls the wire fed by the wire feeding unit and that winds the wire around a binding object; and a binding unit that grips and twists the wire wound around a binding portion by the curl guide and thereby bind the binding object, wherein the binding unit includes a bending portion which bends the wire such that end portions of the wire after binding the binding object are located closer to the binding object than tip portions of the wire, the top portions fully protruding in a direction in which the wire is separated from the binding object.

(Additional Note 2)

The binding machine according to (1), wherein the bending portion includes a fulcrum part which is a bending fulcrum when the wire are bent, and a bending part which bends the wire by using the fulcrum part as a fulcrum.

(Additional Note 3)

The binding machine according to (2), wherein the bending part is provided to be movable toward and away from the binding object, moves toward the binding object by a predetermined distance, and thereby bends the wire toward a binding object side by using the fulcrum part as a fulcrum.

(Additional Note 4)

The binding machine according to any one of (1) to (3), wherein:

the binding unit includes a gripping unit which grips the wire; and the bending portion bends the wire gripped by the gripping unit.

(Additional Note 5)

The binding machine according to (4), wherein the bending portion bends the wire gripped by the gripping unit before the wire are twisted.

(Additional Note 6)

The binding machine according to (4) or (5), wherein the bending part is provided around the gripping unit, and is movable in an axial direction of the gripping unit.

(Additional Note 7)

The binding machine according to (6), wherein the bending part is provided to cover at least a part of the gripping unit (Additional Note 8)

The binding machine according to any one of (4) to (7), wherein the fulcrum part is provided for the gripping unit.

The gripping also includes a state in which the wires are held to be immovable by a pair of gripping members as well as a state in which the wires is movable between the pair of gripping members and which is called locking.

This application is based upon and claims the benefit of priority from Japanese Patent Application No. 2015-145283 filed on Jul. 22, 2015 and Japanese Patent Application No. 2016-136067 filed on Jul. 8, 2016, the entire contents of which are incorporated herein by reference.

REFERENCE SIGNS LIST

1A: reinforcing bar binding machine
2A: magazine
20: reel
3A: wire feeding unit (feeding unit)
4A: parallel guide (feeding unit)
5A: curl guide unit (feeding unit)
6A: cutting unit
7A: binding portion (binding unit)
8A: binding unit driving mechanism
30L: first feed gear
30R: second feed gear
31L: tooth portion
31La: tooth bottom circle
32L: first feed groove
32La: first inclined surface
32Lb: second inclined surface
31R: tooth portion
31Ra: tooth bottom circle
32R: second feed groove
32Ra: first inclined surface
32Rb: second inclined surface
33: driving unit
33*a*: feed motor
33*b*: transmission mechanism
34: displacement unit
50: first guide unit
51: second guide unit
52: guide groove
53: guide pin
53*a*: retreat mechanism
54: fixed guide unit
54*a*: wall surface
55: movable guide unit
55*a*: wall surface
55*b*: shaft
60: fixed blade portion
61: rotary blade portion
61*a*: shaft
62: transmission mechanism
70: gripping unit
70C: fixed gripping member (one gripping member)
70L: first movable gripping member (the other gripping member)
70R: second movable gripping member
71: bending portion (bending unit)
71*a*, 71*b*: bending portion
80: motor
81: reduction gear
82: rotary shaft
83: movable member
W: wire

The invention claimed is:

1. A binding method comprising:

feeding a wire housed in a housing;

winding the fed wire in a loop around a binding object;

after forming the loop, feeding the wire in a reverse direction to tighten the loop about the binding object;

cutting the wire after feeding the wire in the reverse direction;

bending the wire such that end portions of the wire which bind the binding object are located closer to the binding object than a top portion of the wire which protrudes the most in a direction away from the binding object; and twisting the wire after the wire is bent.

2. The binding method according to claim 1, further comprising simultaneously feeding two wires in parallel, and wherein in forming the loop, the two wires in parallel are simultaneously wound about the binding object to form a single loop comprising the two wires; and wherein the method further comprises guiding the two wires such that they are maintained in parallel with an axis of one wire of the two wires offset from an axis of a second wire of the two wires.

3. The binding method according to claim 2, wherein after bending and twisting of the wire, the top portion is the vertically highest part of the wire and the end portions are vertically lower than the top portion.

4. The binding method according to claim 2, wherein the feeding the wire in the reverse direction includes feeding the two wires in the reverse direction after forming the loop, the method further including cutting the wire after forming the loop and prior to the bending of the wire.

* * * * *